US007394065B2

(12) United States Patent
Grimm, II et al.

(10) Patent No.: US 7,394,065 B2
(45) Date of Patent: Jul. 1, 2008

(54) CHEMICAL PROBE USING FIELD-INDUCED DROPLET IONIZATION MASS SPECTROMETRY

(75) Inventors: Ronald L. Grimm, II, Costa Mesa, CA (US); Jesse L. Beauchamp, LaCanada Flintridge, CA (US)

(73) Assignee: California Institute of Technology, Pasadena, CA (US)

( * ) Notice: Subject to any disclaimer, the term of this patent is extended or adjusted under 35 U.S.C. 154(b) by 273 days.

(21) Appl. No.: 11/390,695

(22) Filed: Mar. 28, 2006

(65) Prior Publication Data

US 2006/0249672 A1 Nov. 9, 2006

Related U.S. Application Data

(60) Provisional application No. 60/665,673, filed on Mar. 28, 2005.

(51) Int. Cl.
*H01J 49/04* (2006.01)
*H01J 49/10* (2006.01)

(52) U.S. Cl. ..... 250/288

(58) Field of Classification Search ..... 250/288, 250/281, 282

See application file for complete search history.

(56) References Cited

U.S. PATENT DOCUMENTS 4,542,293 A * 9/1985 Fenn et al. ..... 250/288
5,436,446 A * 7/1995 Jarrell et al. ..... 250/288
5,945,678 A * 8/1999 Yanagisawa ..... 250/423 F

* cited by examiner

*Primary Examiner*—Jack I Berman
(74) *Attorney, Agent, or Firm*—Christie, Parker & Hale, LLP.

(57) ABSTRACT

A method and apparatus for probing the chemistry of a single droplet are provided. The technique uses a variation of the field-induced droplet ionization (FIDI) method, in which isolated droplets undergo heterogeneous reactions between solution phase analytes and gas-phase species. Following a specified reaction time, the application of a high electric field induces FIDI in the droplet, generating fine jets of highly charged progeny droplets that can then be characterized. Sampling over a range of delay times following exposure of the droplet to gas phase reactants, the spectra yield the temporal variation of reactant and product concentrations. Following the initial mass spectrometry studies, we developed an experiment to explore the parameter space associated with FIDI in an attempt to better understand and control the technique. In an alternative embodiment of the invention switched electric fields are integrated with the technique to allow for time-resolved studies of the droplet distortion, jetting, and charged progeny droplet formation associated with FIDI.

29 Claims, 24 Drawing Sheets

Prior Art

Prior Art

Prior Art

Prior Art $$E_{inside} = \frac{3E}{\varepsilon + 2} \approx \frac{3E}{\varepsilon}$$

$$\mu = \frac{\varepsilon - 1}{\varepsilon + 2} r^3 E$$

$$E_{inside} \rightarrow E$$

CHEMICAL PROBE USING FIELD-INDUCED DROPLET IONIZATION MASS SPECTROMETRY

CROSS-REFERENCE TO RELATED APPLICATIONS

This application claims priority based on U.S. provisional application No. 60/665,673, filed Mar. 28, 2005, the disclosure of which is incorporated herein by reference.

STATEMENT OF FEDERAL FUNDING

The Government has certain rights in this invention, based on support for the work under a grant from the National Science Foundation (Grant No. CHE-0416381).

FIELD OF THE INVENTION

The current invention is directed generally to an interfacial chemical probe; and more particularly to an interfacial chemical probe that uses field-induced droplet ionization mass spectrometry.

BACKGROUND OF THE INVENTION

In the past twenty years, charged droplets and strong electric fields have quietly revolutionized chemistry. In combination with an atmospheric-sampling mass spectrometer, charged droplets containing biomolecules or polymers have become a source for desolvated, gas-phase ions of these analytes. The process by which charged droplets evaporate is remarkably "soft" in that the process imparts little to no energy to the resulting ions. One technique, electrospray ionization (ESI), is the current "state of the art" for biomolecule mass analysis.

A schematic of the electrospray process is shown in FIG. 1. Here an analyte-containing liquid is pumped through a capillary needle. A high voltage source establishes an electric field between the needle and a plate. Sufficiently high voltages produce strong fields within the liquid itself drawing the liquid to a tip as it exits the needle. From this tip, commonly referred to as a Taylor cone, the liquid sprays outward as charged droplets that are accelerated in the electric field toward the plate. When the plate contains an inlet to a mass spectrometer, analyte within the charged droplets may be mass analyzed. (See, e.g., *Electrospray Ionization Mass Spectrometry*; Cole, R. B., Ed.; John Wiley and Sons: New York, 1997, the disclosure of which is incorporated herein by reference.)

The phenomenon of electrospray was investigated long before it was applied to the study of gas phase ions transferred from solution. In 1750, French clergyman and physicist Jean-Antoine (Abbé) Nollet reported the earliest known reference to electrospray, over two hundred years before the term was coined. He demonstrated that water flowing from a vessel would aerosolize when the vessel was electrified and placed near electrical ground. He also observed that "a person, electrified by connection to a high-voltage generator, would not bleed normally if he were to cut himself; blood would spray from the wound." (For discussion, see ORNL Review, State of the Laboratory, vol. 29 no. 1-2 1995, the disclosure of which is incorporated herein by reference) Roughly one hundred years later, Lord Kelvin designed an apparatus consisting of two liquid nozzles connected to opposite collection reservoirs. Small statistical differences in charging between water dripping from the nozzles quickly led to kilovolt differences and electrosprays at the nozzles. (See, e.g., Smith, J. N. Fundamental Studies of Droplet Evaporation and Discharge Dynamics in Electrospray Ionization, California Institute of Technology, 2000.)

In the early twentieth century, refined experimental techniques allowed for a more rigorous understanding of the electrostatics and electrodynamics of these phenomena. John Zeleny classified the formation of ethanol electrosprays through photographs. (See, e.g., Zeleny, J. *Phys. Rev.* 1917, 10, 1.) The sprays characterized in Zeleny's work are structurally similar to those employed for mass spectrometry today in which liquid is drawn into a conical shape before breaking into a fine mist of charged droplets. This work was followed by rigorous studies of the field-dependent deformation of soap films over cylindrical tubes by Wilson and Taylor. The conical shape of these films resembled Zeleny's observations of ethanol, and indeed has come to be termed the "Taylor cone" based on later theoretical work by G. I. Taylor. (See, e.g., Taylor, G. *Proc. R. Soc. London, Ser. A* 1964, 280, 383; and Taylor, G. *Proc. R. Soc. London, Ser. A* 1966, 291, 159, the disclosures of which are incorporated herein by reference.)

By the middle of the twentieth century, electrospray had become a popular painting technique. Reports by Hines, Tilney and Peabody, and several patents demonstrate the ease with which paint is atomized and applied to vehicles, housewares, and various metal goods. (See, e.g., Hines, R. L. *J. Appl. Phys.* 1966, 37, 2730; and Tilney, R.; Peabody, H. W. *Brit. J. Appl. Phys.* 1953, 4, S51, the disclosures of which are incorporated herein by reference.) However, it was not until 1968 that electrospray was introduced as a scientific tool. Dole and coworkers employed electrospray ionization to transfer high molecular weight polystyrene ions into the gas phase from a benzene/acetone solution. (Dole, M.; Mack, L. L.; Hines, R. L.; Mobley, R. C.; Ferguson, L. D.; Alice, M. B. *J. Chem. Phys.* 1968, 49, 2240, the disclosure of which is incorporated herein by reference.) Their combination of electrospray and nozzle skimmer/pumping systems are similar to those employed today to transfer the charged species from atmospheric pressure into the vacuum system for analysis. Despite this novel approach, two decades would pass before the technique gained wide acceptance.

In the 1980s John Fenn and coworkers revolutionized the field of mass spectrometry by making electrospray easy and practical for the analysis of large biomolecules and polymers. Fenn's contributions to the body of knowledge surrounding electrospray culminated in his sharing of the 2002 Nobel prize in chemistry. Fenn and coworkers presented a series of papers that permanently established electrospray as a tool to introduce dissolved analytes including low molecular weight cationic clusters, negative ions, polyethylene glycol, and several biomolecules into the gas phase for mass analysis. (See, e.g., Yamashita, M.; Fenn, J. B. *J. Phys. Chem.* 1984, 88, 4451; Yamashita, M.; Fenn, J. B. *J. Phys. Chem.* 1984, 88, 4671; Wong, S. F.; Meng, C. K.; Fenn, J. B. *J. Phys. Chem.* 1988, 92, 546; and Fenn, J. B.; Mann, M.; Meng, C. K.; Wong, S. F.; Whitehouse, C. M. *Science* 1989, 246, 64, the disclosure of which are incorporated herein by reference.) They noted that electrospray imparts multiple charges to large biomolecules and polymers thus lowering the m/z value allowing biomolecule analysis on mass spectrometers having only a modest m/z range. As a result of all this investigation and development, ESI-MS has become a popular tool for studying noncovalent interactions and characterizing biomolecules. Cole reviews the present state and the diverse applications of electrospray ionization. (*Electrospray Ionization Mass Spectrometry*; Cole, R. B., Ed.; John Wiley and Sons: New York, 1997, the disclosure of which is incorporated herein by reference.) More recent research has considered a broad range of applications from the technologically important processes of electrostatic spraying to the revolution in mass spectrometric studies of biological molecules made possible by electrospray ionization. (See, e.g., Bailey, A. G. *Electrostatic spraying of liquids*; Wiley: New York, 1988; Fenn, J. B.; Mann, M.; Meng, C. K.; Wong, S. F.; Whitehouse, C. M. *Science* 1989, 246, 64; Yamashita, M.; Fenn, J. B. *J. Phys. Chem.* 1984, 88, 4451; *Electrospray Ionization Mass Spectrometry*; Cole, R. B., Ed.; John Wiley and Sons: New York, 1997; Kebarle, P. *J. Mass Spectrom.* 2000, 35, 804; Grimm, R. L.; Beauchamp, J. L. *Anal. Chem.* 2002, 74, 6291; and Smith, J. N.; Flagan, R. C.; Beauchamp, J. L. *J. Phys. Chem. A* 2002, 106, 9957, the disclosures of which are incorporated herein by reference.)

Although the electrospray process is relatively straightforward to implement as an analytical tool for biomolecule mass analysis, research continues to elucidate the mechanisms by which an analyte-containing electrospray generates charged droplets that ultimately result in desolvated, charged, gas-phase molecules. In 1882, Lord Rayleigh considered the electrical pressure resulting from excess charge q on a droplet of spherical radius r and surface tension σ. His theory predicts that the natural quadrupolar oscillation of a droplet in an electrical field-free environment becomes unstable when q exceeds the limit $q_R$, now known as the "Rayleigh limit", defined in Equation 1.

$$q_R=8\pi(\sigma\epsilon_0 r^3)^{1/2} \quad (1)$$

The limit is reached either by solvent evaporation which decreases r or by application of charge in excess of $q_R$. At $q \geqq q_R$, Rayleigh postulated that the droplet would throw out liquid in "fine jets." (See, Rayleigh, L. *Philos. Mag.* 1882, 14, 184, the disclosure of which is incorporated herein by reference.) This event is referred to in the literature as Rayleigh discharge or Coulomb fission. (See, e.g., Smith, J. N.; Flagan, R. C.; Beauchamp, J. L. *J. Phys. Chem. A* 2002, 106, 9957; Grimm, R. L.; Beauchamp, J. L. *Anal. Chem.* 2002, 74, 6291; and Kebarle, P. *J. Mass Spectrom.* 2000, 35, 804, the disclosures of which are incorporated herein by reference.) Despite a rigorous prediction of when the event occurs, Rayleigh's analysis does little to describe the dynamics of the discharge event.

Recent articles by Cole and by Kebarle and Peschke summarize the research performed to further elucidate the dynamics of a Rayleigh discharge. (See, Cole, R. B. *J. Mass Spectrom.* 2000, 35, 763; and Kebarle, P.; Peschke, M. *Analytica Chimica Acta* 2000, 406, 11, the disclosures of which are incorporated herein by reference.) FIG. 2 presents a schematic summary of the current view of the "lifetime" of a charged droplet. In the consensus view, charged, micrometer-sized droplets eject numerous progeny droplets having a diameter roughly one-tenth that of the parent. Other experiments and models such as the ion desorption model and the charge residue model address phenomena involving smaller droplets in the nanometer regime. Ultimately the result of ion desorption or the charge residue mechanism is a desolvated ion, or in some cases an ion-bound solvent cluster such as water. (See, e.g., Lee, S. W.; Freivogel, P.; Schindler, T.; Beauchamp, J. L. *J. Am. Chem. Soc.* 1998, 120, 11758, the disclosure of which is incorporated herein by reference.)

Table 1, below, summarizes the conclusions of Rayleigh discharge experiments found in the literature. This list is not inclusive, but rather shows the breadth and scope of the studies and their conclusions. Charged droplets generally undergo Rayleigh discharge while they are at 70-120% of their Rayleigh limit of charge (i.e. $q=0.7\ q_R$ to $1.2\ q_R$). For instance, Taflin and co-workers found discharge occurring below 90% the Rayleigh limit with charge loss ranging from 10 to 18%, and 1-2% mass loss in dodecaonol, hexadecane, heptadecane, dibromooctane, and bromodecane. (See, e.g., Taflin, D. C.; Ward, T. L.; Davis, E. J. *Langmuir* 1989, 5, 376, the disclosure of which is incorporated herein by reference.)

TABLE 1

DROPLET CHARACTERISTICS

| Author(s) | Solvent | Location | Droplet Diam. (μm) | % $q/q_R$ at Rayleigh Discharge | % Mass Lost | % Charge Lost |
|---|---|---|---|---|---|---|
| Li, Tu, and Ray, 2005 | diethyl phthalate | balance | 5-25 | 96 | 2.3 | 21 |
| | diethylene glycol | | | 100 | <0.3 | 38 |
| | triethylene glycol | | | 100 | <0.3 | 41 |
| | hexadecane | | | 97 | 1.5 | 15 |
| Duft et al., 2003 | ethylene glycol | balance | 48 | 100 | 0.3 | 33 |
| Duft et al., 2002 | ethylene glycol | balance | 3-25 | >95 | n/a | ~25 |
| Smith, Flagan, and Beauchamp, 2002 | water | IMS | 10-60 | 100 | n/a | 20-40 |
| | methanol | | | 120 | | 15-20 |
| | acetonitrile | | | 100 | | 15-20 |
| Feng et al., 2001 | methanol | balance | 20-42 | ~100 | n/a | 80 |
| Widmann et al., 1997 | 50 BTD, 50 IDD | balance | 25-30 | 3 | 24 | 21 |
| | 50 BTD, 50 IDD | | 17-28 | 3 | 75 | 74 |
| | hexanediol diacrylate | | 22 | 64 | n/a | n/a |
| Gomez, Tang, 1994 | heptane | ESI plume | 32-80 | 60-80 | n/a | n/a |
| Richardson et al., 1989 | n-octanol | balance | 1-10 | 102 | 2.3 | 15 |
| | sulfuric acid | | 1-10 | 84 | <0.1 | 49 |
| Taflin, Ward, and Davis, 1989 | bromododecane | balance | 44 | 72 | n/a | 12 |
| | dibromooctane | | 26-40 | 86 | 1.8 | 16 |
| | dibutyl phthalate | | 20 | 75 | n/a | n/a |
| | docecanol | | 36-38 | 85 | 2 | 15 |
| | hexadecane | | 28-64 | 73 | 1.6 | 17 |
| | heptadecane | | 28-36 | 79 | 1.6 | 12 |
| Roulleau et al., 1972 | water | balance | 50-200 | ~100 | n/a | n/a |
| Schweizer et al., 1971 | n-octanol | balance | 15-40 | ~100 | 5 | 23 |
| Berg et al., 1970 | balance | balance | 30-250 | 25-100 | n/a | n/a |

TABLE 1-continued

| DROPLET CHARACTERISTICS | | | | | | |
|---|---|---|---|---|---|---|
| Author(s) | Solvent | Location | Droplet Diam. (μm) | % $q/q_R$ at Rayleigh Discharge | % Mass Lost | % Charge Lost |
| Ataman et al., 1969 | n-octanol | balance | 30-60 | ~100 | n/a | n/a |
| Doyle, et al., 1964 | n/a | balance | 60-200 | n/a | n/a | 30 |

Abbreviations:
BTD: 1-bromotetradecane,
IDD: 1-iodododecane,
IMS: ion mobility cell,
balance: electrodynamic balance,
ESI: electrospray ionization,
n/a: not available.
References: Taflin, D. C.; Ward, T. L.; Davis, E. J. Langmuir 1989, 5, 376; Gomez, A.; Tang, K. Phys. Fluids 1994, 6, 404; Duft, D.; Lebius, H.; Huber, B. A.; Guet, C.; Leisner, T. Phys. Rev. Lett. 2002, 89, art. no. 084503; Li, K.-Y.; Tu, H.; Ray, A. K. Langmuir 2005, 21, 3786; Duft, D.; Atchtzehn, T.; Muller, R.; Huber, B. A.; Leisner, T. Nature 2003, 421, 6919; Feng, X.; Bogan, M. J.; Agnes, G. R. Anal. Chem. 2001, 73, 4499; Widmann, J. F.;Aardahl, C. L.; Davis, E. J. Aerosol Science and Technology 1997, 27, 636; Richardson, C. B.; Pigg, A. L.; Hightower, R. L. Proc. Roy. Soc. A 1989, 422, 319; Roulleau, M.; Desbois, M. J. Atmos. Sci. 1972, 29, 565; Schweizer, J. D.; Hanson, D. N. J. Colloid and Interface Sci. 1971, 35, 417; Berg, T. G. O.; Trainor, R. J.; Vaughan, U. J. Atmos. Sci. 1970, 27, 1173; Ataman, S.; Hanson, D. N. Ind. Eng. Chem. Fundam. 1969, 8, 833; andDoyle, A.; Moffett, D. R.; Vonnegut, B. J. Colloid Sci. 1964, 19, 136.

High speed photography of charged droplets in an electrospray plume by Gomez and Tang support the prevailing theories of Rayleigh discharge. FIG. 3 shows a charged droplet undergoing jetting in an event attributed to Rayleigh discharge. In this event, it is clear that the parent is elongating and emitting a series of fine progeny droplets. Although they did not measure the charge lost during Rayleigh discharge, they noted the occurrence at ~60 to 80% the Rayleigh limit, and the photograph supports other experimental findings of little mass loss. (See, e.g., Gomez, A.; Tang, K. *Phys. Fluids* 1994, 6, 404, the disclosure of which is incorporated herein by reference.)

More recently, Duft and co-workers explored Rayleigh discharge through accurate measurements of the quadrupolar oscillations in a droplet suspended in an alternating current electric field. Through a calculation of the Coloumb energy and surface energy of a droplet, they determined that ethylene glycol undergoes discharge at 100% $q_R$ without reliance on the bulk surface tension parameter σ to determine $q_R$, allowing multiple characterizations and the development of a time profile of droplet size and charge. (See, e.g., Duft, D.; Lebius, H.; Huber, B. A.; Guet, C.; Leisner, T. *Phys. Rev. Lett.* 2002, 89, art. no. 084503, the disclosure of which is incorporated herein by reference.) That droplets are repeatedly characterized in a small measurement volume before and after Rayleigh discharge suggests a "soft" event in which little, if any, momentum is imparted to the parent droplet. This work also suggests a solvent dependence on the charge loss and the percent Rayleigh limit at discharge. (See, e.g., Smith, J. N.; Flagan, R. C.; Beauchamp, J. L. *J. Phys. Chem. A* 2002, 106, 9957, the disclosure of which is incorporated herein by reference.)

The Rayleigh discharge phenomenon is the result of excess electrical pressure within a droplet. In this case, the electrical pressure of high charge drives an instability leading to jetting of fine jets of charged progeny droplets. However, electrical pressure leading to droplet instability may also be due to an applied strong electric field. Concurrent with investigations into the electrospray phenomenon, investigators considered the behavior of electric fields on neutral water droplets. Early researchers saw meteorological implications and focused on how fields within clouds would affect rain and aerosol drops. (See, e.g., Wilson, C. T. R. *Phil. Trans. A* 1921, 221, 104; Wilson, C. T. R.; Taylor, G. I. *Proc. Cambridge Philos. Soc.* 1925, 22, 728; Nolan, J. J. *Proc. R. Ir. Acad. Sect. A* 1926, 37, 28; Macky, W. A. *Proc. Roy. Soc. A* 1931, 133, 565; O'Konski, C. T.; Thacher, H. C. *J. Phys. Chem.* 1953, 57, 955; and Taylor, G. *Proc. R. Soc. London, Ser. A* 1964, 280, 383, the disclosures of which are incorporated herein by reference.) In a classic 1931 experiment, Macky dropped ~1 to 5 mm diameter water droplets through a strong electric field with the apparatus shown in FIG. 4*a*. (See, e.g., Macky, W. A. *Proc. Roy. Soc. A* 1931, 133, 565, the disclosure of which is incorporated herein by reference.) Here a voltage difference between plates (i) and (ii) defines a high electric field. Water droplets are produced from reservoir (iii) through a stopcock (v) and field-free region (iv). Macky observed that strong electric fields caused droplets to elongate into spheroids prolate to the electric field. At a critical field strength $E_c^0$, droplets developed instabilities resulting in the formation of two symmetrical fine filaments from opposing sides of the droplet. FIG. 4*b* shows this elongation and instability in photographs of 5 mm diameter water droplets exposed to a 8250 V $cm^{-1}$ electric field. We call this droplet instability and jetting phenomenon field-induced droplet ionization (FIDI). FIG. 5 shows a single 170 μm diameter methanol droplet undergoing FIDI elongation and jetting. (See, e.g., Grimm, R. L.; Beauchamp, J. L. *J. Phys. Chem. B* 2003, 107, 14161, the disclosure of which are incorporated herein by reference.)

In general terms, excess electrical pressure leading to FIDI develops in droplets of radius r and surface tension σ when the applied field exceeds a critical value, $E_c^0$ known as the Taylor limit, shown in Equation (2), named for G. I. Taylor who pioneered the corresponding theory. (See, e.g., Taylor, G. *Proc. R. Soc. London, Ser. A* 1966, 291, 159; and Basaran, O. A.; Scriven, L. E. *Phys. Fluids A* 1989, 1, 799, the disclosures of which are incorporated herein by reference.)

$$E_c^0 = \frac{1.625}{(8\pi)^{1/2}}\left(\frac{2\sigma}{\varepsilon_0 r}\right)^{1/2} \tag{2}$$

In Equation (2), the fitting constant c has been determined both empirically and theoretically, and the accepted value is 1.625 for liquid droplets in air. (See, e.g., Macky, W. A. *Proc. Roy. Soc. A* 1931, 133, 565; O'Konski, C. T.; Thacher, H. C. *J. Phys. Chem.* 1953, 57, 955; Taylor, G. *Proc. R. Soc. London, Ser. A* 1964, 280, 383; and Inculet, I. I.; Kromann, R. *IEEE Trans. Ind. Appl.* 1989, 25, 9454, S51, the disclosures of which are incorporated herein by reference.) Assuming droplets always distort into spheroidal shapes, Taylor additionally derived Equations (3) and (4), the general relationship between an applied electric field $E<E_c^0$ and the resulting aspect ratio $\gamma=a/b$ of the major to minor axis of the spheroid.

$$E = I_2\gamma^{-4/3}(2-\gamma^{-3}-\gamma^{-1})^{1/2}\left(\frac{2\sigma}{\varepsilon_0 r}\right)^{1/2} \tag{3}$$

$$I_2 = \frac{1}{2(1-\gamma^{-2})^{3/2}}\ln\left[\frac{1+(1-\gamma^{-2})^{1/2}}{1-(1-\gamma^{-2})^{1/2}}\right] - \frac{1}{1-\gamma^{-2}} \tag{4}$$

In Equation (3), the coefficient $I_2$ is a higher-order function of $\gamma$ represented by Equation (4). Although a simple relation does not exist for $\gamma(E)$ in the spheroidal approximation, Equation (5) approximates the relationship between $\gamma$ and E in Equation (3) to within 1% for fields less than 55% of the Taylor limit. (See, Saville, D. A. *Annu. Rev. Fluid Mech.* 1997, 29, 27, the disclosure of which is incorporated herein by reference.)

$$\gamma(E) = \left(1+\frac{9r\varepsilon_0 E^2}{16\sigma}\right)\left(1-\frac{9r\varepsilon_0 E^2}{16\sigma}\right)^{-1} \tag{5}$$

Equation (3) predicts $\gamma$ increases with increasing E until $\gamma=1.85$ where the droplet becomes unstable corresponding to $E=E_c^0$. This relationship is supported by experimental and theoretical evidence for neutral droplets and soap films in air. (See, e.g., Wilson, C. T. R.; Taylor, G. I. *Proc. Cambridge Philos. Soc.* 1925, 22, 728; and Basaran, O. A.; Scriven, L. E. *Phys. Fluids A* 1989, 1, 799, the disclosures of which are incorporated herein by reference.)

Using these theoretical predictions it is possible to determine the electrical field necessary to produce charged ions from droplets. For example, FIGS. 6 and 7 explore Taylor's spheroidal approximation as applied to droplets relevant to the current discussion. FIG. 6 shows Equation (3) plotted for 225 μm, 500 μm, and 2.25 mm diameter droplets. Each curve demonstrates that the equilibrium aspect ratio increases with applied field for $0<E<E_c^0$ and curves inward at higher aspect ratio values. This turning point agrees well with the Taylor limit presented by Equation (2). At the Taylor limit, the equilibrium aspect ratio is approximately 1.85. FIG. 6 demonstrates that for a given applied electric field, larger droplets will be more elliptical than smaller droplets and corroborates Equation (2), which suggests that larger droplets require lower field strengths to become unstable and exhibit jetting.

FIG. 7 plots the equilibrium aspect ratio for 225 μm diameter droplets of methanol and water. For a specific applied field and droplet size, droplets with a lower surface tension have a greater equilibrium aspect ratio. This plot also shows that 225 μm water droplets do not undergo jetting under standard atmospheric conditions because the necessary field is greater than the $3\times10^6$ V $m^{-1}$ dielectric breakdown limit of air. For this droplet, air will break down and arc before the Taylor limit of field is reached. Indeed, inserting $E_c^0=3\times10^6$ V $m^{-1}$ and $\sigma=0.072$ N $m^{-1}$ into Equation (2), the smallest water droplet that demonstrates jetting and FIDI would be ~380 μm in diameter. Practical considerations that lower the breakdown limit of air such as humidity and burrs on the electrodes could be used to raise the practical water droplet diameter minimum to about 500 μm.

Additionally, between the Rayleigh limit of charge and the Taylor limit of field exists the general case where excess electrical pressure within a droplet results from both net charge and the externally applied electric field. For a droplet of charge q, this shape becomes unstable at a critical electric field, $E_c^q$. The critical field is a function of net charge as increasing charge reduces the field necessary to create an instability, or $0\leqq E_c^q \leqq E_c^0$ for $0\leqq q\leqq q_R$.

Although chemistry on and within liquid droplets is ubiquitous in nature and anthropomorphic processes, investigators have only begun to understand and harness such reactions. Liu and Dasgupta review applications of liquid droplets to problems including window-less spectroscopy, solvent extraction, and trace gas detection. (See, Liu, H. H.; Dasgupta, P. K. *Microchemical Journal* 1997, 57, 127-136, the disclosure of which is incorporated herein by reference.) Because of the desire to understand the behavior of aerosols in the atmosphere, much of the recent work is devoted to understanding heterogeneous reactions between droplets and reactive gas-phase species. (See, Finlayson-Pitts, B. J.; Pitts Jr., J. N. *Chemistry of the Upper and Lower Atmosphere: Theory, Experiments, and Applications*; Academic Press: San Diego, 2000, the disclosure of which is incorporated herein by reference.) Popular techniques for studying atmospherically relevant heterogeneous chemistry include falling-drop and aerosol time-of-flight (ATOF) mass spectrometry (MS) experiments. For example, real-time Raman spectroscopy has enabled researchers to examine heterogeneous reactions on single droplets suspended in an electrodynamic balance. (See, e.g., Davis, E. J.; Aardahl, C. L.; Widmann, J. F. *J. Dispersion Sci. Technol.* 1998, 19, 293-309; Buehler, M. F.; Davis, E. J. *Colloids Surf., A* 1993, 79, 137-149; Musick, J.; Popp, J. *Phys. Chem. Chem. Phys.* 1999, 1, 5497-5502; and Musick, J.; Popp, J.; Trunk, M.; Kiefer, W. *Appl. Spectrosc.* 1998, 52, 692-701, the disclosures of which are incorporated herein by reference.) The Agnes group established the viability of offline mass spectrometric analysis of individual soft-landed droplets that had previously been suspended in an electrodynamic balance (EDB). They further demonstrated that the suspended droplet may undergo heterogeneous reactions that may be subsequently characterized through offline mass spectrometry. (See, Bogan, M. J.; Agnes, G. R. *Anal. Chem.* 2002, 74, 489-496; and Feng, X.; Bogan, M. J.; Chuah, E.; Agnes, G. R. *J. Aerosol Sci.* 2001, 32, 1147-1159, the disclosures of which are incorporated herein by reference.) More recently, using a constant stream of droplets generated by a vibrating orifice aerosol generator, it has been demonstrated that the charged progeny droplets emitted from parent droplets in a FIDI event are a viable source of gas-phase ions for mass analysis. (See, e.g., Grimm, R. L.; Beauchamp, J. L. *J. Phys. Chem. B* 2003, 107, 14161-14163, the disclosure of which is incorporated herein by reference.)

A great deal of work is still needed to develop a complete picture of both electrospray and field-induced droplet ionization mass spectrometry. For example, as a result of the complexity of examining a falling droplet or a spray of droplets few studies have probed the chemical aspects and implications of charged droplet phenomena. Specifically, because of their inherently transient nature, these droplet streams are difficult to manipulate and utilize as chemical probes. In addition, although Taylor's analysis predicts the field necessary for droplet instability and jetting through Equation (2), the analysis does not predict the timescales or the dynamics of the process. Accordingly more efficient ion sources and applications are needed for understanding and refining the use of droplets as a chemical probe, as well as new applications to mass spectrometry. These applications motivate the present disclosure.

SUMMARY OF THE INVENTION

The current invention is directed generally to a chemical analysis probe apparatus that utilizes a FIDI-MS technique.

In one embodiment of this invention, the apparatus includes a droplet source in fluid communication with a probe liquid reservoir, the droplet source having an outlet where a droplet of probe liquid is produced.

In another embodiment of this invention, the apparatus includes a droplet positioner for holding and maintaining the droplet in a stationary position during analysis.

In still another embodiment of this invention, the apparatus includes a target material source being disposed such that a target material can be brought into contact with the probe liquid droplet.

In still yet another embodiment of the invention, the target is light that is directed into the liquid droplet to initiate or propagate a chemical change in the droplet.

In still yet another embodiment of the invention, the target light is supplied from a laser.

In yet another embodiment of the invention, the apparatus includes an electrical field generator disposed such that the probe liquid droplet is exposed to the field, the electrical field generator producing an electrical field having a field strength sufficient to create a distortion within the probe liquid droplet, the distortion forming at least one jet of material that separates from the probe liquid droplet.

In still yet another embodiment of the invention, the apparatus includes a mass detector having a detector opening, the mass detector being disposed such that the jet of material is directed through the opening into the mass detector.

In still yet another embodiment of the invention, the droplet source is a capillary, and wherein the droplet positioner is the outlet of the capillary, where the droplet is formed and held for analysis.

In still yet another embodiment of the invention, the droplet source is an injector, and the droplet positoner is an electrodynamic trap.

In still yet another embodiment of the invention, the droplet source is a droplet placed or located on a super hydrophobic surface, and wherein the droplet positioner is a local electric field for lifting the droplet into place for analysis.

In still yet another embodiment of the invention, the electric field that induces FIDI is selected from the group consisting of static, pulsed, and oscillating.

In still yet another embodiment of the invention, the droplet is neutral and forms two oppositely charged jets of material upon distortion.

In still yet another embodiment of the invention, the droplet is charged and forms a single jet of material upon distortion.

In still yet another embodiment of the invention, the target material is in one of an aqueous, gaseous, or solid phase.

In still yet another embodiment of the invention, the apparatus further comprises a droplet aligner including an adjustable stage for orienting the droplet positioner in one or multiple dimensions, and an alignment imager for imaging the orientation of the jets of material in relation to the mass detector. In one such embodiment, the alignment imager is a CCD camera.

In still yet another embodiment of the invention, the apparatus further comprises at least one supplemental analyzer for analyzing a physical aspect of the droplet in a field free environment either before or after the FIDI distortion of the droplet.

In still yet another embodiment of the invention, the electrical field generator is a switched field, and a time-resolved droplet imager in line of sight with said droplet, wherein the droplet imager is synchronized with the switching of the electrical field. In one such embodiment, the time-resolved droplet imager is a pulsed flashlamp having a collimated beam directed at a CCD camera.

In still yet another embodiment of the invention, the droplet source produces a steady stream of probe liquid such that droplets are continually forming and growing, wherein the electrical field generator is always activated such that when a droplet reaches a critical size it undergoes a distortion based on the Taylor limit. In one such embodiment, the droplet source is the outlet of a gas chromatograph.

In another embodiment, the current invention is direct to a method of probing a chemical process using a FIDI-MS technique.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Introduction

Figure 1:
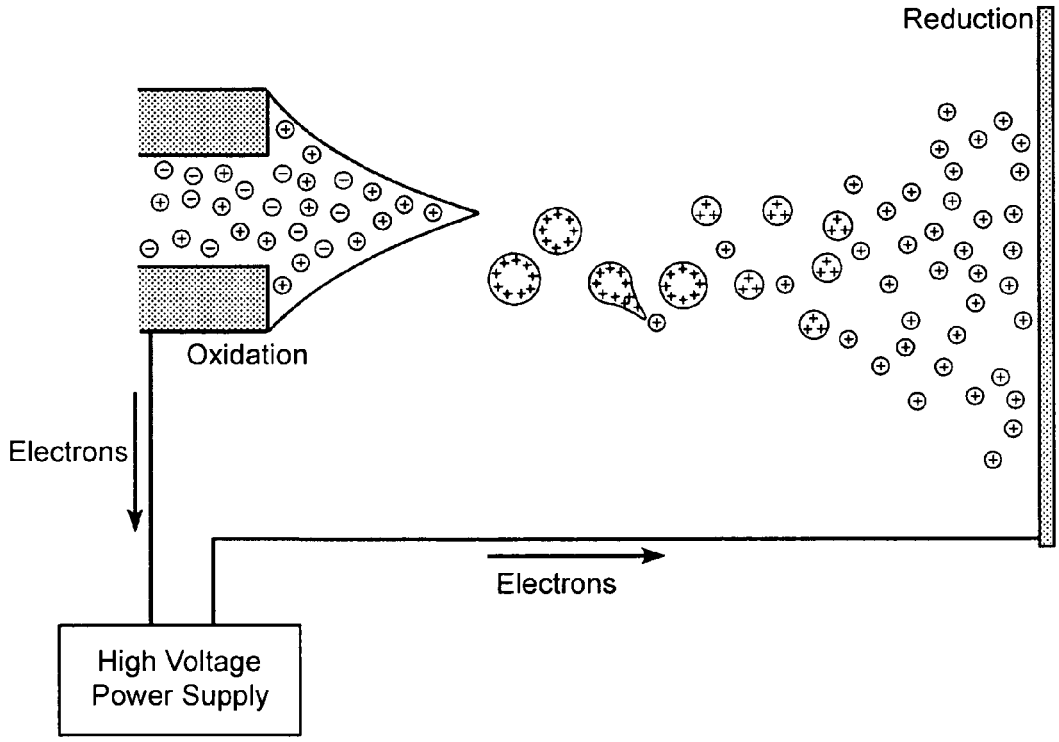
FIG. 1, provides a schematic of a prior art electrospray ionization technique.
Figure 2:
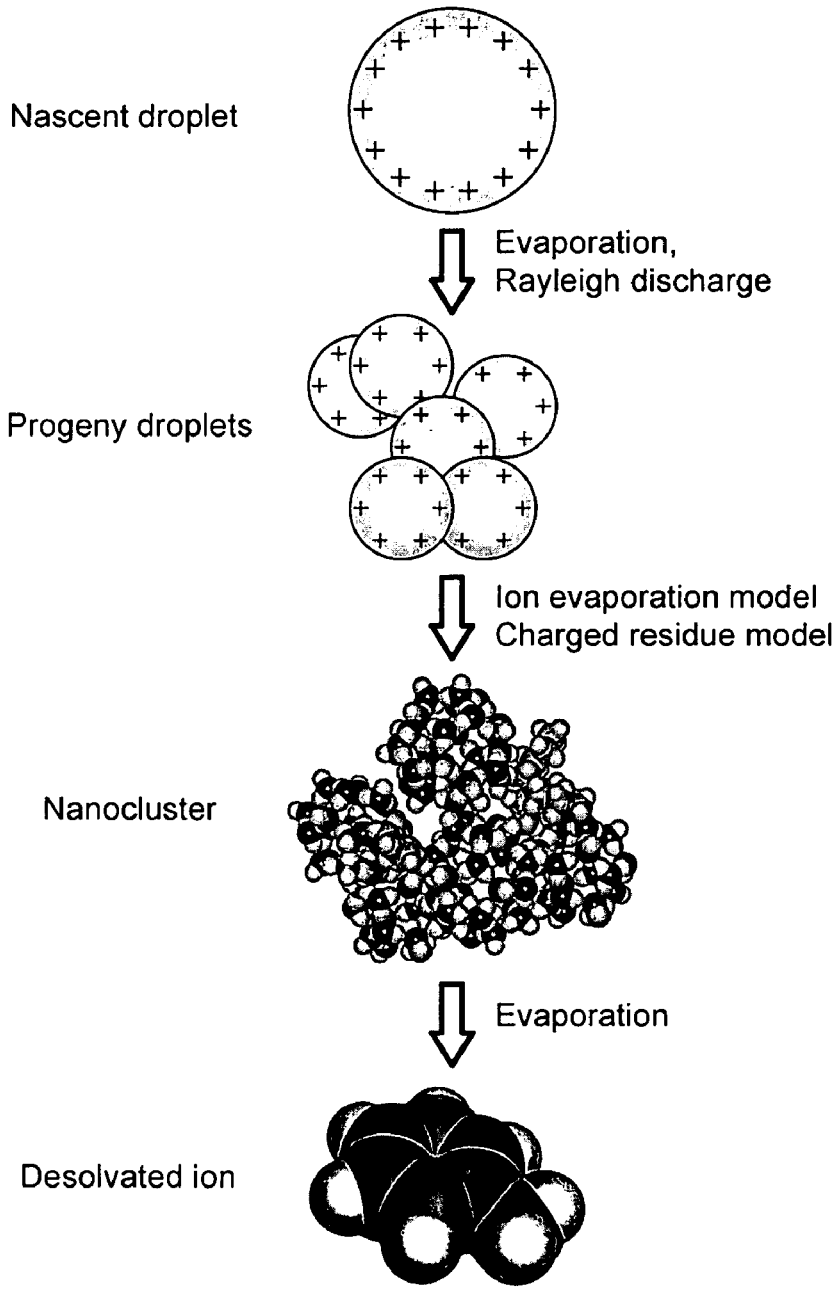
FIG. 2, provides a schematic of the evolution of a droplet in a droplet ionization process.
Figure 3:
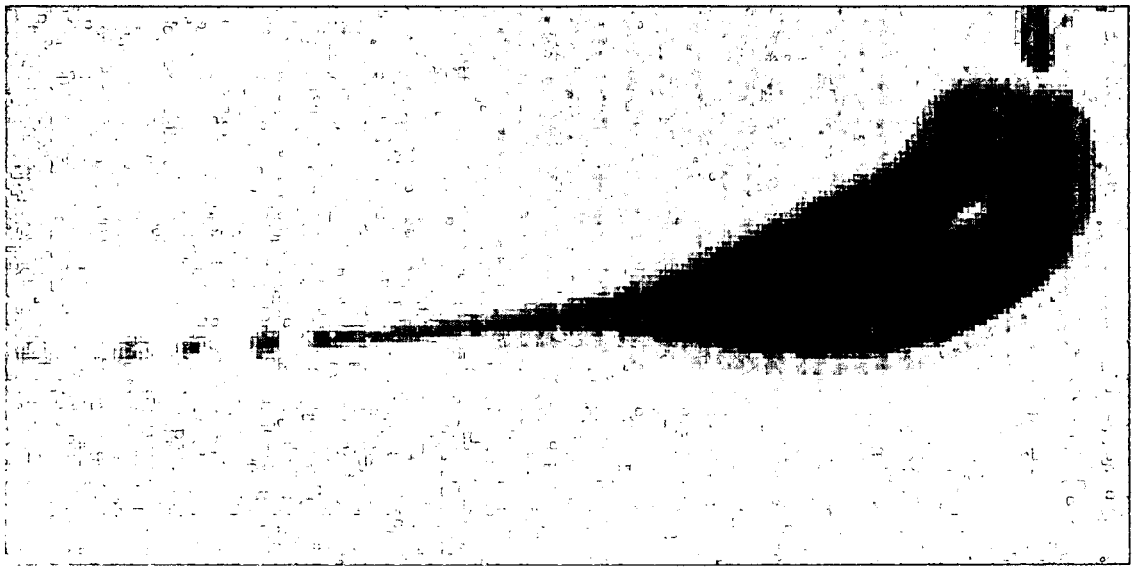
FIG. 3, provides a photograph of instability and jetting from a charged heptane droplet within an electrospray plume in accordance with the prior art.
Figure 4:
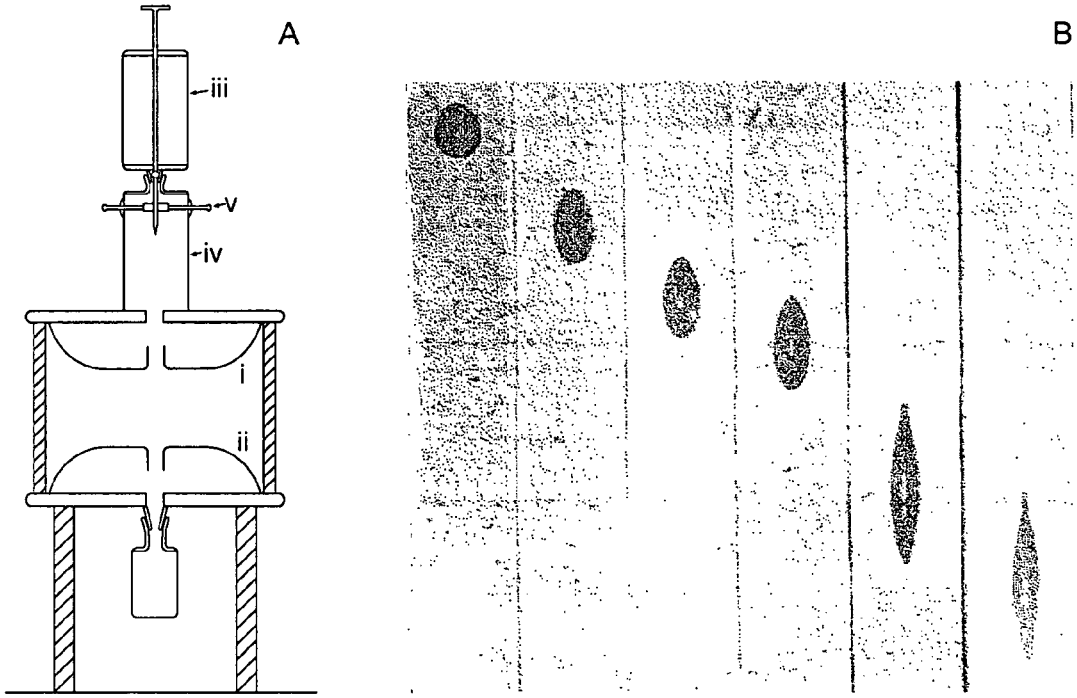
FIGS. 4*a* & *b*, provide a prior art apparatus (A), and photographs of droplets formed in strong electric fields (B) in accordance with such an apparatus.

Unless defined otherwise, all technical and scientific terms used herein have the same meaning as commonly understood to one of ordinary skill in the art to which this invention belongs. Although any methods, devices and materials similar or equivalent to those described herein can be used in the practice or testing of the invention, the preferred methods, devices and materials are now described.

All publications mentioned herein are incorporated herein by reference for the purpose of describing and disclosing, for example, the cell lines, constructs, and methodologies that are described in the publications which might be used in connection with the presently described invention. The publications discussed above and throughout the text are provided solely for their disclosure prior to the filing date of the present application. Nothing herein is to be construed as an admission that the inventors are not entitled to antedate such disclosure by virtue of prior invention.

The current invention is directed to a chemical probe that incorporates the technique of a field-induced droplet ionization mass spectrometry (FIDI-MS). The FIDI-MS technique of the current invention also incorporates novel dynamics measurements that allow for better control of the droplet distortion during the FIDI technique.

The controlled single droplet mass spectrometry in accordance with the current invention represents an ideal solution to the challenges presented by the analysis of microliters and less of sample and the on-line characterization of heterogeneous and interfacial reaction chemistry occurring on individual droplets. The dynamically controlled FIDI-MS set forth herein allows for the analysis of the progress of chemical reactions within droplets, detection of trace gas-phase species, and mass sampling of a selected droplet from an assembly of multiple droplets. In addition, because of the on-demand nature of the current technique, the droplet can be exposed to a target species, either from a different solution, in a solid form, or from the atmosphere for a controlled period of time before FIDI, which provides the capability to explore heterogeneous chemistry occurring between components in the target and analytes within the droplet.

Utilizing an exemplary embodiment of the switched electric field apparatus, the temporal evolution of droplets leading to FIDI events is characterized as a function of electric field strength and droplet net charge following exposure of the droplet to a rapidly switched electric field. These droplet dynamics investigations are presented below. In brief, the dynamics studies established a relationship between the timescale to initiate droplet distortion and charged progeny formation to the bulk physical parameters of a droplet. Understanding the FIDI timescales allowed the development of an exemplary FIDI-MS apparatus also presented below.

Discussion of Dynamics Investigations

In addition to describing new methodologies for FIDI-MS, the current invention is also directed to a method and system for examining the temporal evolution of droplet shapes leading to FIDI events. Such dynamics studies allow one to tune the operation of the FIDI-MS device to provide an on-demand FIDI event.

In one embodiment of the apparatus, the dynamics of this process can be investigated using switched high electric fields to enable time-resolved studies of droplet distortion, Taylor cone formation, and charged progeny droplet extraction from neutral and charged 225 micron methanol droplets. After a specific time in the field, a flashlamp is triggered to record droplet distortions using shadow photography. At a critical field strength $E_c^0$ corresponding to the Taylor limit defined by Equation (2), neutral droplets exhibit a prolate elongation along the field axis forming symmetric cone-jets of positive and negatively charged progeny droplets, approximately 10 microns in diameter. This process is termed field-induced droplet ionization (FIDI). Because the timescale of FIDI is related to the frequency of shape oscillations that occur below the Taylor limit, models of field-dependent oscillation become an important predictor of the timescale for progeny jet formation. Droplets with a net charge q distort into asymmetric tear shapes and emit a single charged jet of progeny at a critical field $E_c^q$ that is less than $E_c^0$. The measured decrease in droplet stream charge indicates that total charge loss can be greater than the original charge on the droplet, resulting in oppositely charged droplets. Interestingly, above $E_c^0$, charged droplets sequentially emit a jet of the same polarity as the net charge followed by a jet of reverse polarity emitted in the opposite direction. For both neutral and charged droplets, increasing the electric field decreases the time to form jets and the combination of net charge and higher-than-critical fields has a compound effect in accelerating progeny formation.

The implications are that the current invention may be used for on-demand ion sampling from neutral or charged droplets.

Using these theoretical calculations, then, and given the specific size, composition, and charge of an individual droplet, it is possible to determine the magnitude of the electric field required to produce jetting, the timescale of the event, and the efficiency with which analyte species are converted into the gas-phase ions and sampled by a mass spectrometer, allowing for on-demand ion sampling from neutral or charged droplets utilizing the current invention.

Accordingly, in one embodiment of the invention, the apparatus includes additional equipment to examine the dynamics of the FIDI process. As will be discussed further in the following section, the dynamics apparatus uses switched high electric fields and a synchronized imaging device to enable time-resolved studies of droplet distortion, Taylor cone formation, and charged progeny droplet extraction. During operation, the droplet is exposed to a highly switching electric field, and then after a specific time in the field, a imager is triggered to record droplet distortions using shadow photography.

Figure 8:
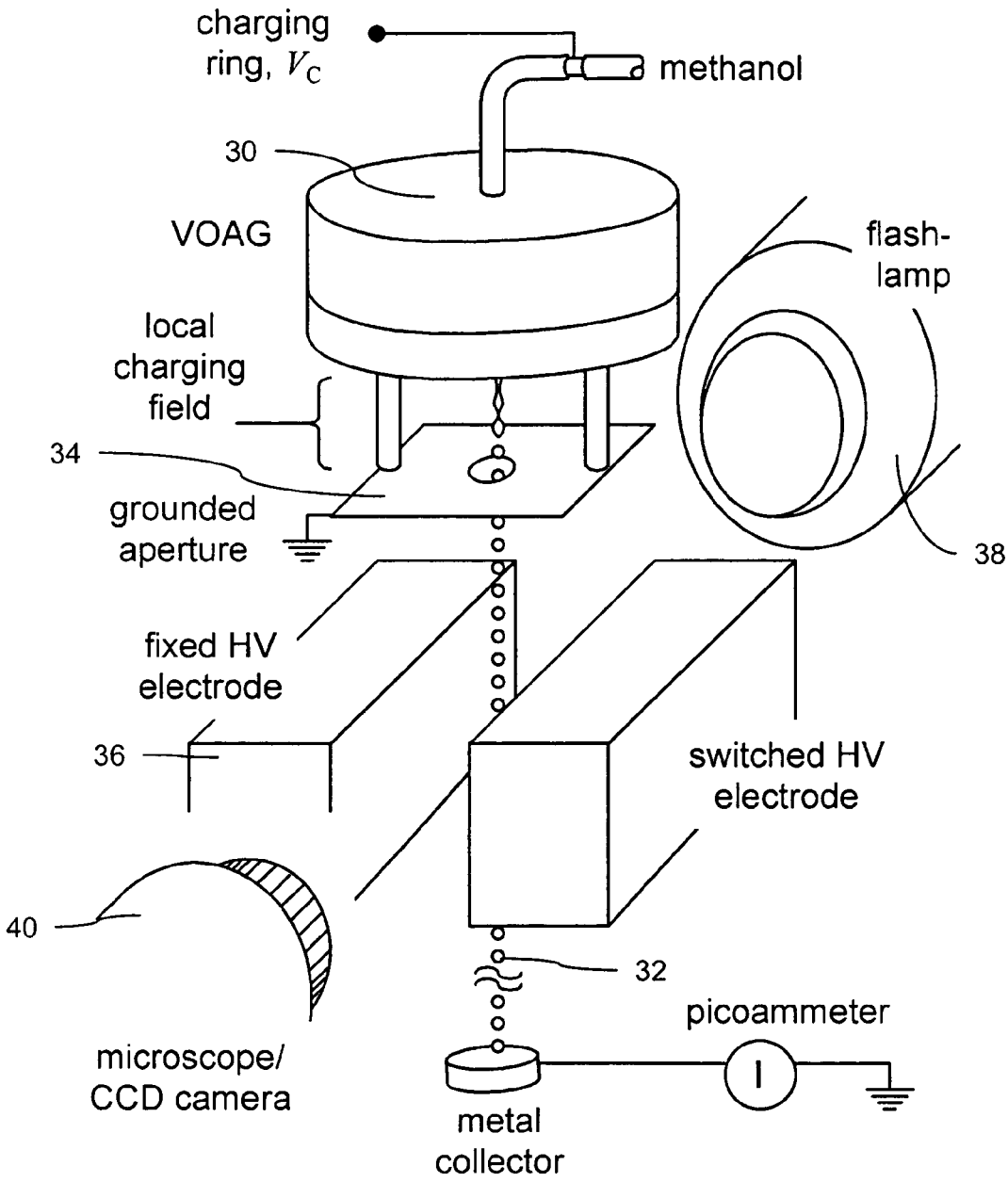
FIG. 8, provides a schematic diagram of a dynamics instrument in accordance with another exemplary embodiment of the current invention.

FIG. 8 shows a schematic of an exemplary dynamics apparatus. A vibrating orifice aerosol generator (VOAG) (30) creates a monodisperse droplet stream (32). HPLC-grade methanol (EMD Chemicals Inc.) is used without further purification. A nitrogen-backed solution reservoir (not shown) delivers methanol to the VOAG. Nitrogen gas (1-3 psig) pumps the methanol giving a smoother flow rate and a more stable stream than a syringe pump. A 130 μm I.D. ceramic orifice (4P480-0016-343; Kulicke and Soffa Inc., Willow Grove, Pa., USA) is mounted within an annular piezoelectric actuator vibrating in the direction of the methanol flow at 11.4 kHz. The ~5 m $s^{-1}$ stream breaks into droplets that pass through a grounded aperture.

Droplet charge is governed by the local electric field at the point at which the stream breaks into droplets. Before the orifice, the methanol passes through a metal charging ring (34) connected to a voltage supply, $V_C$, establishing a field between the stream and the grounded aperture. Setting $V_C$ to ground generates neutral droplets while increasing $V_C$ between 0 and 600 V linearly increases the net charge between 0% and 13% of the Rayleigh limit. Higher net charge results in excessive space-charge repulsion between the droplets causing a disruption of the stream. A digital picoammeter (model 485, Keithley Instruments, Inc.) measures the total current to ground resulting from the droplets impacting a metal collector. Individual droplet charge is calculated from this current and the droplet production rate. A step-function drop in the picoammeter current indicates the amount of charge droplets lose during FIDI by comparing the current from droplets both before and after FIDI events. Droplet charging is not affected by other electric fields in the experiment.

The droplets pass between two 6.5 mm long parallel-plate electrodes (36) spaced 1.4 mm apart that define the FIDI region. Calculations in SIMION verify the field gradient approximates a parallel-plate capacitor to within 4% over 88% of its length when the droplet path bisects the electrodes. (See. e,g., Dahl, D. A. *SIMION* 3*D*; Idaho Natl. Eng. and Environ. Lab.: Idaho Falls, Id., 2000, the disclosure of which is incorporated by reference.) In our earlier experiments, this field was fixed by holding one electrode at high voltage (HV) and the other at ground, resulting in a gradual increase in the field experienced by droplets as they entered the high-field region. (See, e.g., Grimm, R. L.; Beauchamp, J. L. *J. Phys. Chem. B* 2003, 107, 14161, the disclosure of which is incorporated herein by reference.) In the present experiment, droplets enter this region when both electrodes are held at an identical high voltage between 2.8 and 3.4 kV creating a field-free region. The left electrode maintains a fixed HV while a stacked circuit of MTP1N100E MOSFETs switches the right-hand plate from HV to ground and remains there for a variable time t=10-900 μs before returning to high-voltage. As a result, droplets are in a well-defined electric field until they are photographed. Based on similar circuits from the literature, this in-house design is capable of switching up to 4 kV to ground in less than 1 μs. (See, e.g., Baker, R. J.; Johnson, B. P. *Rev. Sci. Instrum.* 1992, 63, 5799; and Continetti, D. M.; Cyr, D. R.; Neumark, D. M. *Rev. Sci. Instrum.* 1992, 63, 1840, the disclosures of which are incorporated by reference.) Rather than using an avalanche transistor or a transmission line to drive the FETs, a 6N135 optoisolator drives each FET and isolates the remainder of the electronics from a possible surge or breakdown.

After the variable time, t, following exposure to the high field, a sub-microsecond xenon flashlamp (38) illuminates the droplets. The flashlamp is mounted behind the FIDI region and directs a collimated beam directly at a microscope focused on the droplets. Using a 10× objective, a 10× wide-angle eyepiece adapter (MaxView Plus, Scopetronix, Cape Coral, Fla., USA) and an afocally-coupled CCD camera (40) (C-5060 wide zoom, Olympus), the optical train resolves 5 μm features. Acquiring images of droplets and progeny for t ranging from 10 to 900 μs generates a time-history of droplet response to a specific high electric field.

The study of droplets is partitioned into three specific sections. The first section considers the time-dependent shape oscillations of neutral droplets at fields below $E_c^0$. The oscillation frequency is field-dependent and is a useful predictor for the timescale for FIDI as E approaches $E_c^0$.

The second section considers neutral droplets in fields at and above $E_c^0$. FIDI events are characterized by the highly elliptical shape and presence of jetting from conical tips as a function of time in and strength of the applied electric field. Field strengths required for FIDI are compared to Equation (2) and the timescale for jetting to occur is related to droplet oscillation frequencies from the first case.

The third section investigates droplets between 4% and 13% of their Rayleigh limit of charge in fields at and above their critical field, $E_c^q$. The decrease in $E_c^q$ as a function of q is explored and related to models developed by Basaran and Scriven (Basaran, O. A.; Scriven, L. E. *Phys. Fluids A* 1989, 1, 799) and by Abbas and Latham (xxx), the disclosures of which are incorporated herein by reference.

Each shadowgraph contains 3-5 droplets. For each droplet image, a custom LabView-based edge analysis program developed by the Leisner research group fits an ellipsoid that provides aspect ratio and size information. (See, Leisner, T. *Spindle analysis program*; Technische Universität Ilmenau: Ilmenau, Germany, 2004, the disclosure of which is incorporated herein by reference.) The program verifies the monodispersity of the droplets and computes aspect ratios of 10-20 droplets for each t and electric field strength. The time-dependent aspect ratio, γ(t) is fitted to a damped sine function (6).

$$\gamma(t)=\gamma_\infty+A\sin(2\pi vt+\phi)\exp(-gt) \quad (6)$$

In Equation (6), v is the fitted oscillation frequency in $s^{-}$, A is the amplitude, φ is the phase, $\gamma_\infty$ is the equilibrium aspect ratio or γ(t=∞), and g is the exponential dampening constant. Oscillation frequencies are compared to numerical solutions by Basaran and co-workers and to analytical solutions by Feng and Beard and by Brazier-Smith and co-workers. (See, Basaran, O. A.; Patzek, T. W.; Benner, R. E.; Scriven, L. E. *Ind. Eng. Chem. Res.* 1995, 34, 3454; Feng, J. Q.; Beard, K. V. *Proc. R. Soc. London, Ser. A* 1990, 430, 133; and Brazier-Smith, P. R.; Brook, M.; Latham, J.; Saunders, C. P.; Smith, M. H. *Proc. R. Soc. London, Ser. A* 1971, 322, 523, the disclosures of which are incorporated herein by reference.) Feng and Beard found the field-dependent oscillation frequency $v^{FB}$ to be Equation (7). They suggest the frequency decreases proportionally with $E^2$ until reaching $E_c^0$ where the frequency is given by Equation (8). Brazier-Smith and co-workers derived the oscillation, $v^{BS}$, as a function of the equilibrium aspect ratio, as given by Equation (9).

$$v^{FB} = \frac{8^{1/2}}{2\pi}\left[1 - 2.764E^2\left(\frac{\varepsilon_0 r}{2\sigma}\right)\right]\left(\frac{\sigma}{r^3\rho}\right)^{1/2} \tag{7}$$

$$v^{FB}(E_c^0) = \frac{8^{1/2}}{2\pi}\left[1 - 2.764\frac{1.625^2}{8\pi}\right]\left(\frac{\sigma}{r^3\rho}\right)^{1/2} \tag{8}$$

$$v^{BS} = \frac{8^{1/2}}{2\pi}x^{1/2}\left(\frac{\sigma}{r^3\rho}\right)^{1/2} \tag{9}$$

In Equation (9), x is a multi-component function of γ. Combining the relationships between γ and $v^{BS}$ in Equation (9) and γ and E in Equation (3), Brazier-Smith and co-workers predict $v^{BS}$ decreases to 0 as E approaches $E_c^0$.[34] Equations (7) and (9) reduce to the natural l=2 mode shape oscillation at E=0.

The LabView program determines the aspect ratio assuming a spheroidal shape, which limits rigorous analysis to neutral droplets. Since charged droplets in electric fields are tear-shaped, analysis of the aspect ratio is limited to qualitative comparisons. While this study explores neutral droplets below $E_c^0$, we do not consider charged droplets below $E_c^q$.

Discussion of Dynamics Example 1

Figure 9:
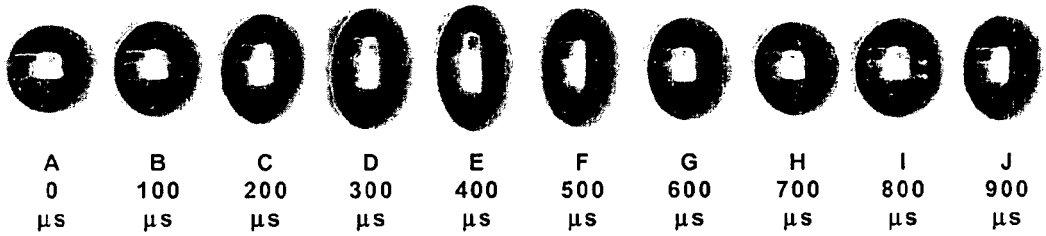
FIGS. 9*a-j*, provide shadowgraphs of the evolution of neutral 225 μm diameter methanol droplets exposed to a $2.00\times 10^6$ V $m^{-1}$ electric field over a period of successive times.
Figure 10:
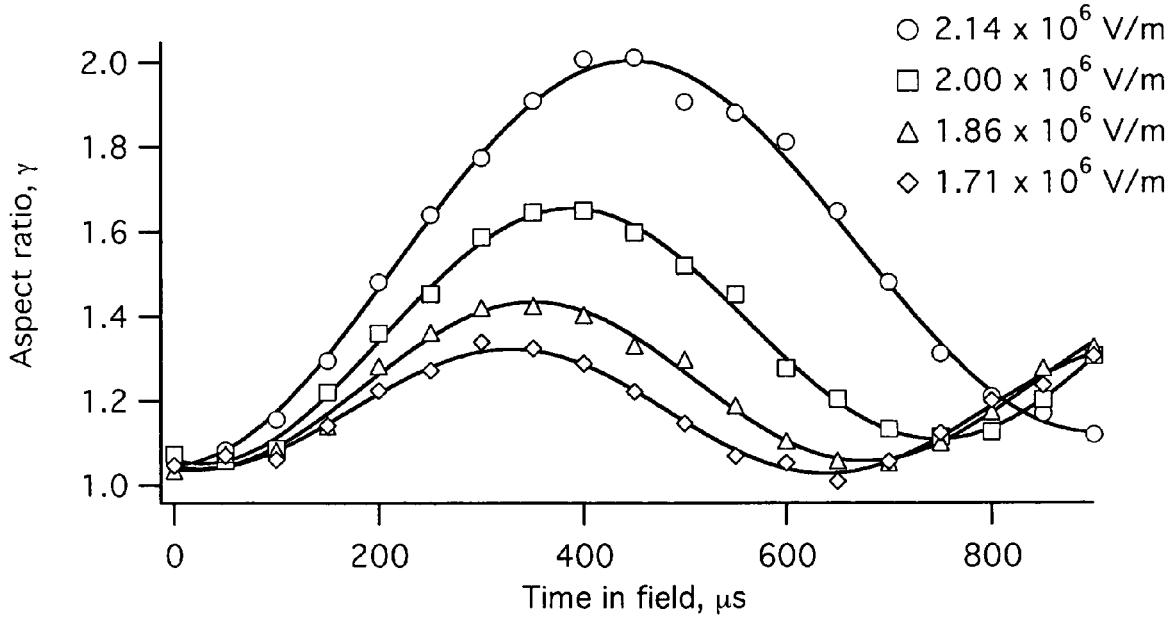
FIG. 10, provides a graph of average aspect ratio, γ, versus time for 225 μm diameter methanol droplets in fields below $E_c^0$ where the spheroid shape oscillates until reaching equilibrium.

First an investigation was undertaken to determine the dynamics of droplets in field below $E_c^0$. FIG. 9 highlights a sequence of droplets in a $2.00\times10^6$ V $m^{-1}$ electric field. Initially, γ(0 μs)=1 corresponding to the spherical droplet (a). A damped shape oscillation is marked by increasing aspect ratios in (b)-(e), decreasing aspect ratios in (e)-(i), and increasing again in (j). FIG. 10 highlights this trend in plots of γ versus the time in the electric field for four field strengths below $E_c^0$. Each point represents the average aspect ratio for approximately ten images at each respective time, and is fit to the exponentially damped sine function (6). The fitted equilibrium aspect ratios, $\gamma_\infty$, strictly increase as the electric field increases and are in excellent agreement with Taylor's theoretical model, Equation (3), for each respective electric field.

Figure 11:
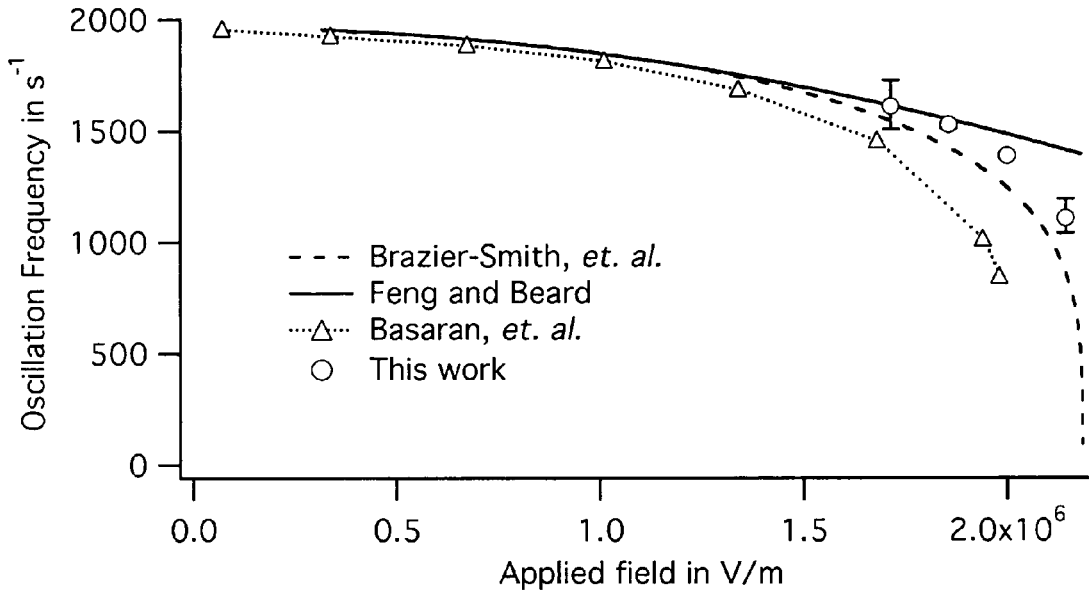
FIG. 11, provides a graph comparison of fitted oscillation frequencies to predictions of Brazier-Smith and co-workers (dashed line), of Feng and Beard (solid line), and of Basaran and co-workers (triangle markers, dotted line) applied to 225 μm methanol droplets. Error bars represent the frequency of damped sine fits to the average aspect ratio values plus and minus the respective standard deviations, respectively. Fitted values from this work are shown with round markers.

FIG. 11 compares the fitted oscillation frequencies from this work (round markers) with the Feng and Beard frequency $v^{FB}$ (solid line), the Brazier-Smith and co-workers frequency $v^{BS}$ (dashed line), and the numerical simulations of Basaran and co-workers (triangle markers, dotted line) which are each dimensionalized for 225 micron methanol droplets. Error bars represent how the uncertainty in the aspect ratio data is reflected in the oscillation frequency. For each electric field strength, uncertainty in the frequency is bounded by fitting the damped sine function to plots of the average aspect ratio minus the standard deviation and plus the standard deviation. The maximum error in the fitted frequency values is 7%. The fitted values from this work follow each of the theoretical trends with decreasing frequencies as the applied field increases. The initial values closely match $v^{FB}$ but diverge to lower frequencies at higher field strengths.

Discussion of Dynamics Example 2

Figure 12:
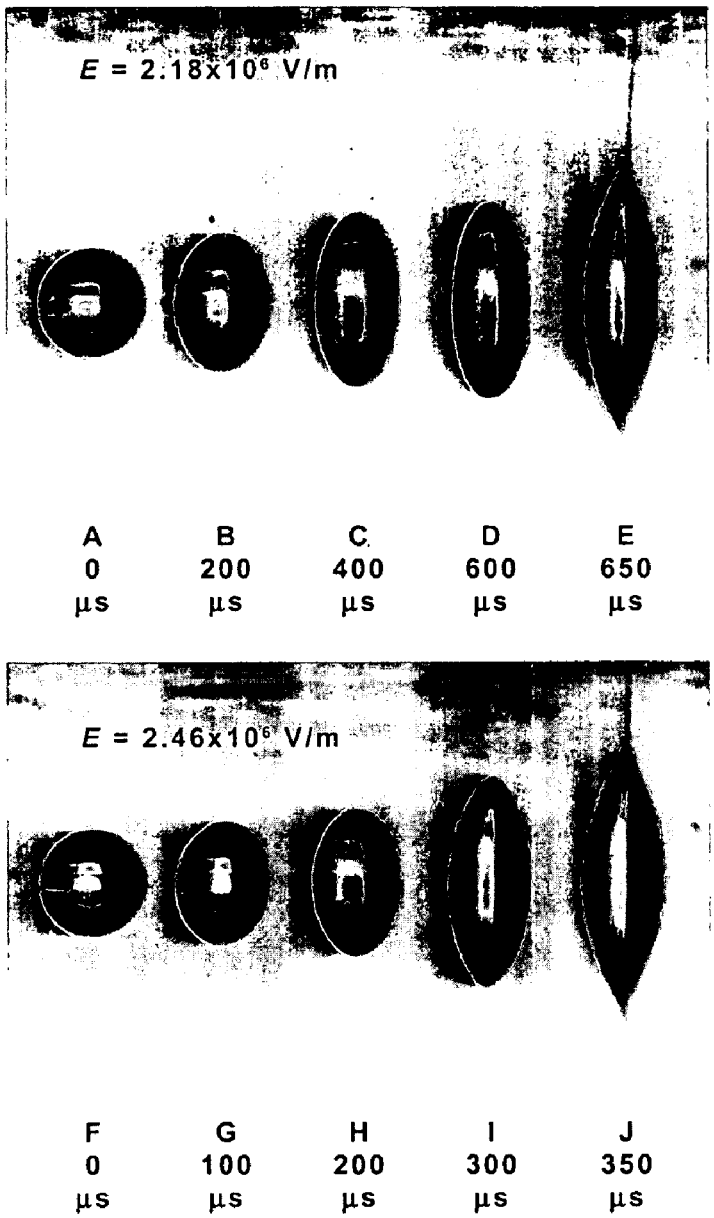
FIGS. 12*a-j*, provide a sequences shadowgraphs of 225 μm droplets exposed to an electric field for the indicated time period.
Figure 13:
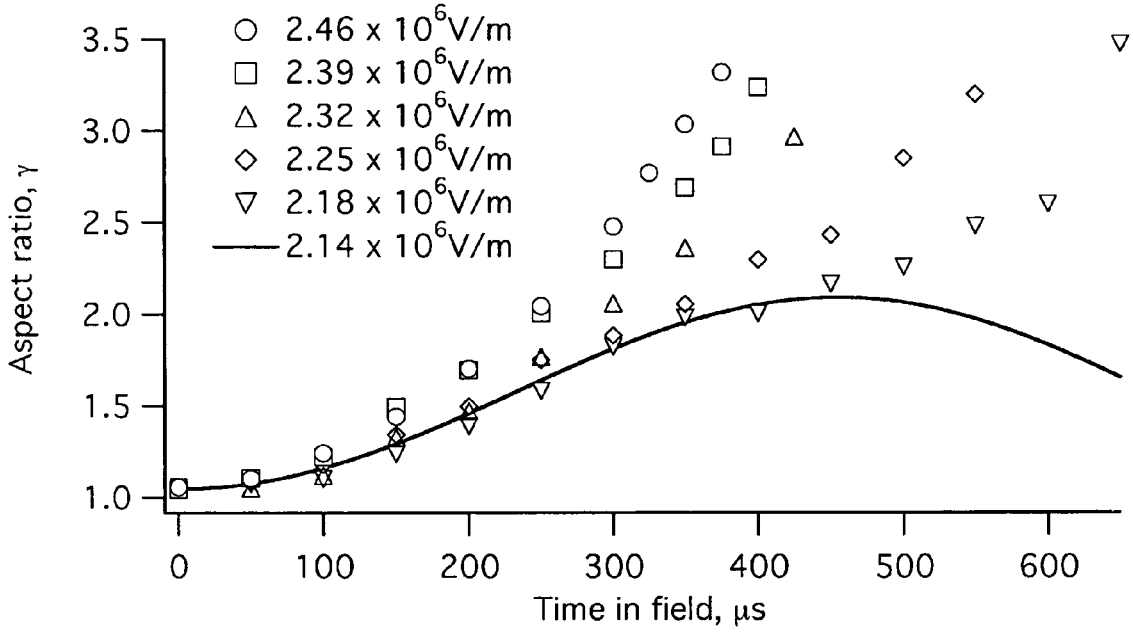
FIG. 13, provides a graph of the average aspect ratio, γ, versus time for 225 μm diameter methanol droplets in fields sufficiently high for FIDI.

The second investigation was undertaken to determine the dynamics of neutral droplets in field above $E_c^0$. FIG. 12 shows 225 μm diameter droplets symmetrically elongating and jetting at two field strengths. Droplets oscillate at $2.14\times10^6$ V $m^{-1}$, as shown by FIG. 11 and undergo FIDI in a $2.18\times10^6$ V $m^{-1}$ field, in good agreement with the value of $E_c^0$ predicted by Equation (2). In a $2.18\times10^6$ V $m^{-1}$ field, jetting begins after 650 μs (FIG. 12*e*), whereas jetting occurs as early as 350 μs in a $2.46\times10^6$ V $m^{-1}$ field (FIG. 12*j*). Thus, the 13% increase in the electric field above $E_c^0$ accelerates the elongation and reduces the time to form jets by 46%. FIG. 13 graphs γ(t) for fields between 2.18 and $2.42\times10^6$ V $m^{-1}$ as well as the fitted oscillation γ(t) at $2.14\times10^6$ V $m^{-1}$ reproduced from FIG. 11. FIG. 13 illustrates this reduction in time to achieve jetting which results from increasing the applied field. For droplets at $E_c^0$, conical shapes begin to form at aspect ratios between 2.5 and 3 following exposure to the high field. At the onset of jetting, the aspect ratio is approximately 3.2. This is consistent over the range of electric fields employed indicating that only the time to reach jetting is affected by field strength, and the shape at the onset remains consistent.

FIG. 13 highlights a fundamental relationship between the droplet oscillation in fields below $E_c^0$, and the elongation leading to FIDI in the critical field. Through 450 μs, or half the oscillation period, the oscillation closely tracks the aspect ratio of droplets undergoing FIDI at $E_c^0$. Beyond 450 μs, the aspect ratio of oscillating droplets decreases while the aspect ratio of droplets undergoing FIDI continues to increase. This pattern corroborates the non-dimensional calculations of Basaran and coworkers. Therefore the response of a droplet in fields slightly below and at $E_c^0$ are proportionally linked and the shape oscillation of a droplet near the critical field becomes an important predictor for the timescales for progeny jet formation at $E_c^0$. Equation (10) empirically relates both the 650 μs time to initiate FIDI, $\tau_{FIDI}$, to the 900 μs oscillation period, $v^{-1}$, for 225 μm droplets and $\tau_{FIDI}$=575 μs to $v^{-1}$=800 μs for similar investigations on 200 μm droplets.

$$\tau_{FIDI} \approx 0.75(v_{E\to E_c^0})^{-1} \tag{10}$$

Equation (10) is comparable to non-dimensional calculations that show a ratio of ~0.6 between the timescale for a droplet to elongate to γ=3.2 in fields above $E_c^0$ to the oscillation period slightly below $E_c^0$.

FIG. 13 also provides insight regarding the fitted oscillation frequency values shown in FIG. 11. Although the fitted oscillation frequency values most closely match the trend of Brazier-Smith and coworkers, $v^{BS}$, that theory predicts the shape oscillation decreases to zero as the applied field reaches $E_c^0$. The similarity between the oscillating droplet and the aspect ratio of droplets undergoing FIDI at $E_c^0$ in FIG. 13 demonstrates that sub-critical oscillations decrease to a finite, non-zero value. The analytical model of Feng and Beard and the numerical model of Basaran and co-workers provide the closest theoretical match with our measured oscillation frequencies. In using Equation (10) to predict the FIDI behavior of a droplet of known physical parameters, Equation (8) currently provides the best approximation of the timescale for progeny drop formation at $E_c^0$.

Discussion of Dynamics Example 3

Figure 14:
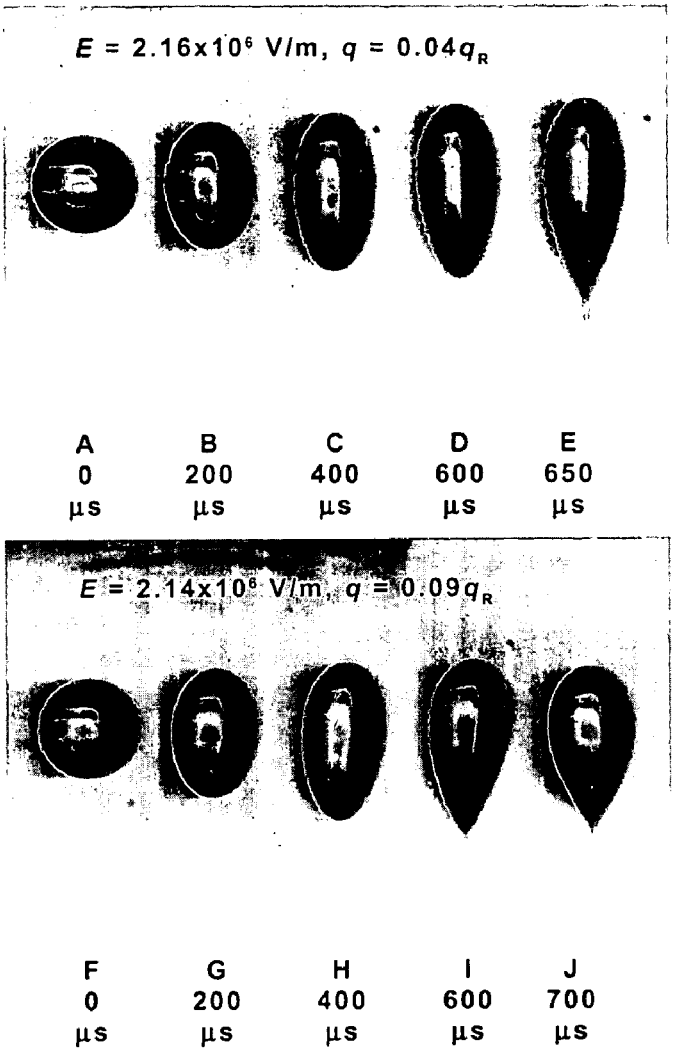
FIGS. 14*a-j*, provide a sequence of shadowgraphs of 225 μm methanol droplets with of $q=0.04\ q_R$ droplets undergoing asymmetrical distortions at $E=2.16\times10^6\ V\ m^{-1}$ and $q=0.09\ q_R$ droplets at $E=2.14\times10^6\ V\ m^{-1}$.

The third investigation was undertaken to determine the dynamics of charged droplets in field above $E_c^0$. FIGS. 14 and 15 show asymmetrical stretching and jetting from charged 225 μm methanol droplets. FIGS. 14*a-e* shows droplets carrying a charge 0.04 $q_R$ in a $2.16\times10^6$ V $m^{-1}$ field and 0.09 $q_R$ droplets in a $2.14\times10^6$ V $m^{-1}$ field in frames (f)-(j). In both cases, droplets are exposed to the minimum field required for jetting, $E_c^q$, for each respective q. Similarly, FIG. 15*a-h* displays a sequence of 0.13 $q_R$ droplets at their critical field of $2.09\times10^6$ V $m^{-1}$. The non-linear trend in decreasing critical fields agrees with finite-element calculations. (See, e.g., Basaran, O. A.; Scriven, L. E. *Phys. Fluids A* 1989, 1, 799, the disclosure of which is incorporated herein by reference.) Similarly, the time to initiate jetting decreases as net charge increases. At 0.04 $q_R$, jet formation occurs at 650 μs as shown in FIG. 14*e* which is the same timescale observed for neutral droplets at $E_c^0$ (FIG. 12*e*). As the charge increases, the timescale decreases to 600 μs at 0.09 $q_R$ (FIG. 14*i*) and 475 μs at 13% $q_R$ (FIG. 15*d*).

Figure 15:
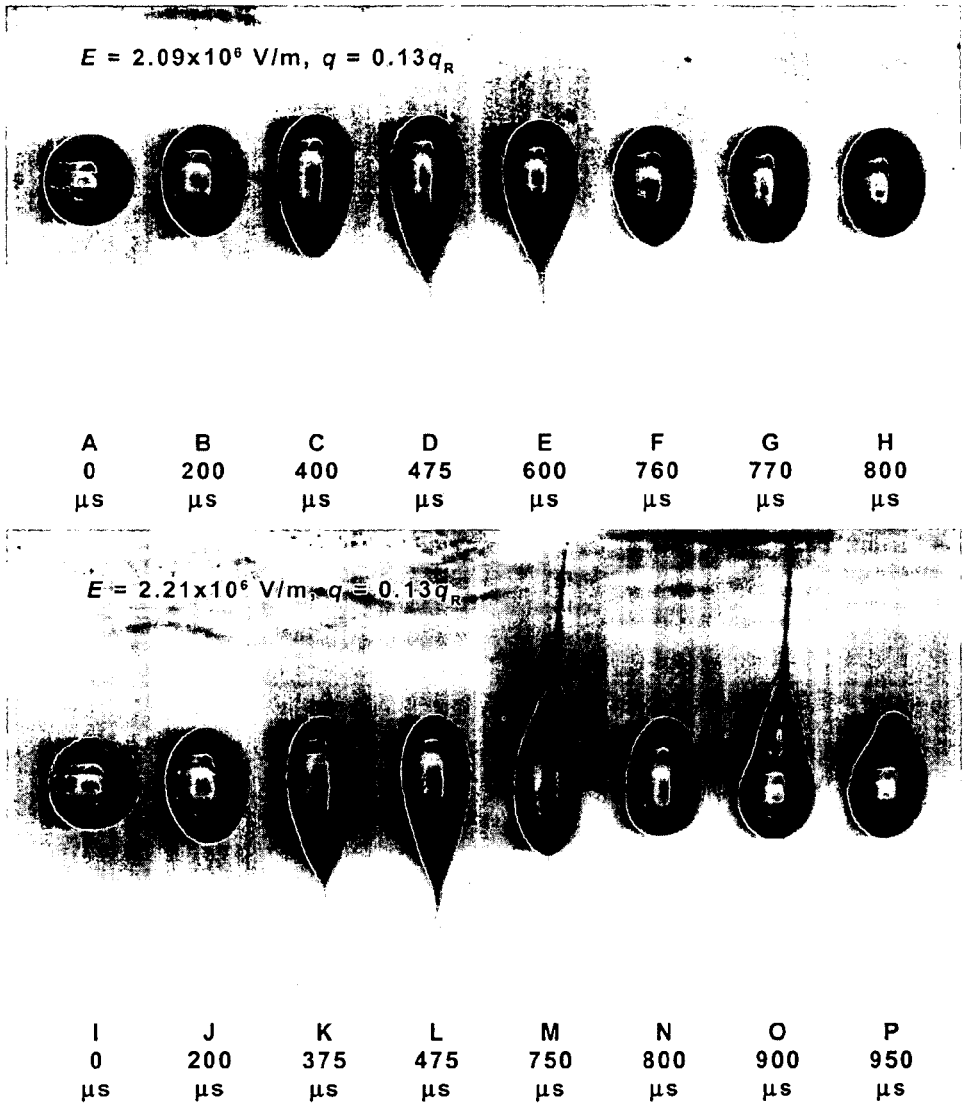
FIGS. 15*a-p*, provide a sequence of shadowgraphs of 225 μm methanol droplets with $q=0.13\ q_R$ in a $2.09\times10^6$ (A)-(H) and a $2.21\times10^6\ V\ m^{-1}$ field (I)-(P).

FIG. 15 includes photographs illustrating the behavior of droplets beyond the initial jetting process. FIG. 15*d* shows a sharp Taylor cone emitting a progeny jet at 475 μs. The initial stages of jetting correspond to the sharpest cones. By 760 μs (FIG. 15*f*), the cone has receded as the jet is emitted from a roughly spheroidal droplet. In frame (g), ten microseconds later, the progeny jet has separated from the completely spheroidal parent. In this case, the duration of the FIDI event is approximately 285 μs.

At higher fields, charged droplets exhibit sequential jetting. FIGS. 15*i-p* illustrate the response of 0.13 $q_R$ charged droplets to a $2.21\times10^6$ V $m^{-1}$ electric field that is 6% higher than $E_c^q$ and 2% greater than $E_c^0$ for neutral droplets of the same size. Droplets distort asymmetrically and emit a positive jet from 375 μs (FIG. 15*k*) through 750 μs (frame m). Unique to this case, droplets develop a second conical tip that emits a short-lived negative progeny jet at 750 μs (frame m). After this sequential jetting, droplets relax into a spade-shaped configuration (frame n) before emitting an additional short-lived negative jet at 900 μs (frame o) from a non-conical tip. We attribute the spade and non-conical shapes of the second negative jet in FIG. 15*n-p* to higher-order, l>2, mode vibrations within the droplet where l=2 is the fundamental mode. (See, e.g., Becker, E.; Hiller, W. J.; Kowalewski, T. A. *J. Fluid Mech.* 1991, 231, 189; and Basaran, O. A.; Scriven, L. E. *Phys. Fluids A* 1989, 1, 795, the disclosures of which are incorporated herein by reference.) Higher-order vibrations are most likely to due to asymmetric flow within the droplet during the initial asymmetric elongation in frames (a)-(d) and the corresponding relaxation in (f)-(h).

Summary of Dynamics Investigations

FIGS. 14 and 15 show progeny droplets separating from the charged droplet jet. Progeny droplets appear at the end of jets from both charged and neutral parents and form due to capillary instability and breakup of the jet. These progeny droplets are approximately 10 μm across or roughly 5% of the diameter of the 225 μm parent droplets. Observations of mass loss are below the measurement limits of the current optical train. If the upper limit of mass loss were bounded at 5%, then 600 progeny droplets, each 10 μm in diameter, would result. The lower bound is the volume within a cylindrical jet at any instant. Jets extend 600 μm to the electrodes, and a 10 μm diameter cylinder of liquid methanol would form ninety 10 μm progeny droplets.

Measurements of the current associated with the droplets stream provide information relating to the droplet charge. Droplets carrying a +0.03 $q_R$ net charge produce a 4.5 nA current with E=0. When the electric field is applied, the timing cycle relative to the droplet flow is such that only 5% of the droplets produced undergo FIDI at a sufficiently high field strength. The remainder of the droplets pass between the electrodes when they are both at high voltage and there is no field between them. The droplets undergoing FIDI lead to a decrease in the picoammeter current of 1.0 nA, indicating that an individual droplet experiences a 1.8 pC loss or 0.13 $q_R$ per FIDI event. Because the droplets initially carried a +0.03 $q_R$ charge, the FIDI event leaves the droplets oppositely charged −0.10 $q_R$. This observation is consistent with the data in FIG. 15*i-p* where following the initial jetting process, the droplets emit jets in the opposite direction.

Figure 16:
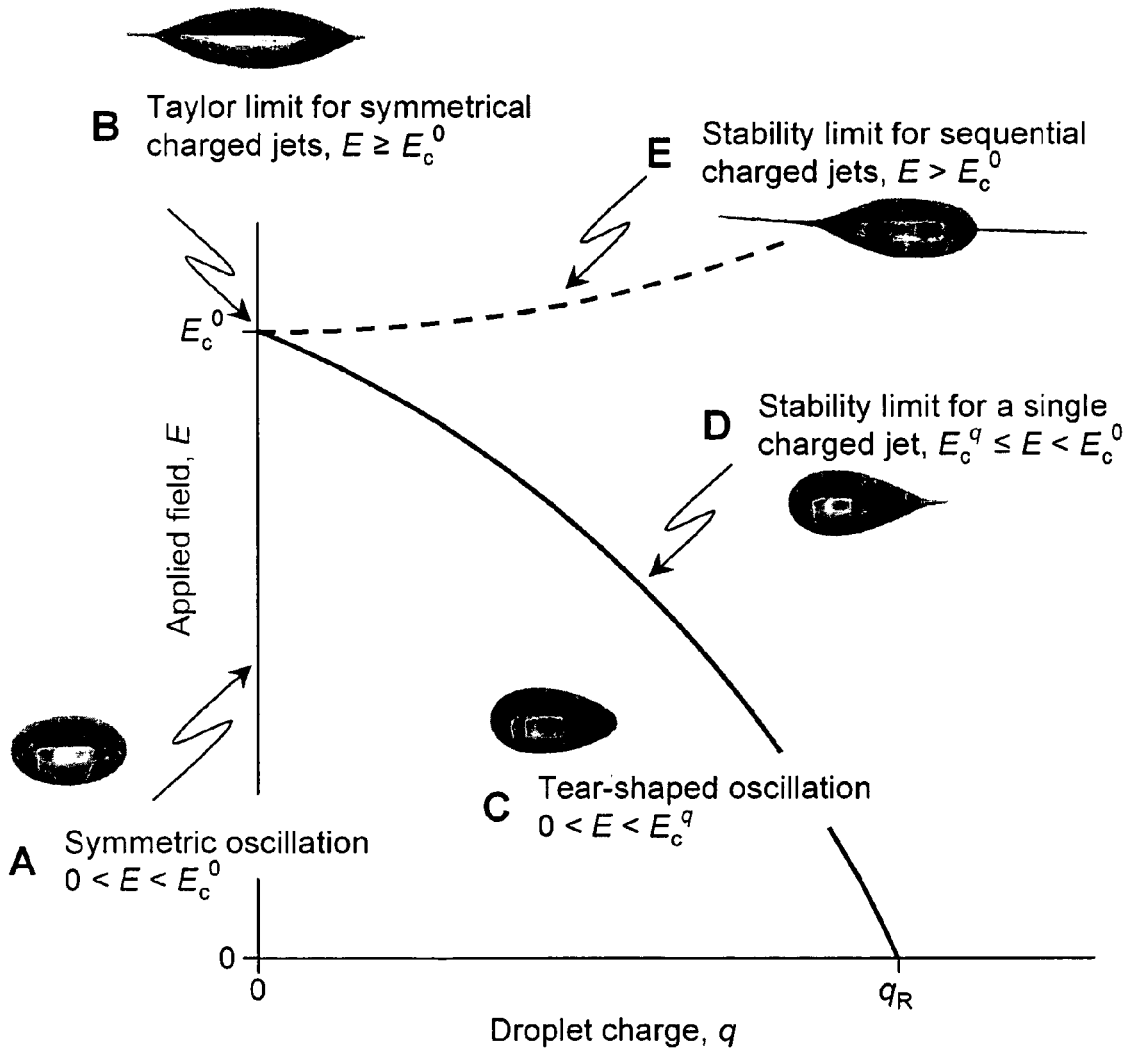
FIG. 16, provides a schematic summary of droplet stability as a function of net charge and applied electric field.

A droplet stability diagram in FIG. 16 summarizes the behavior of droplets as a function of charge and applied electric field. Neutral droplets (FIG. 16*a*) experience prolate shape oscillations in fields below a critical strength, $E_c^0$. Above $E_c^0$ (FIG. 16*b*), droplets form symmetric cone-jets of positive and negative progeny at a rate that may be predicted from the frequency of the sub-critical shape oscillations. Thus theoretical models of shape oscillations are important for studying new systems, as the timescale for the onset of jetting at $E_c^0$ is approximately 75% the oscillation period slightly below $E_c^0$.

The critical limit for charged droplets, $E_c^q$, decreases as charge is increased. This non-linear limit is represented by the solid curve in FIG. 16 and qualitatively follows the shape predicted both by numerical analysis and Taylor's spheroidal approximation. Below $E_c^q$ tear-shaped oscillations are found in charged droplets (FIG. 16*c*) while above $E_c^q$ droplets emit a single charged jet of progeny droplets (FIG. 16*d*). At fields above $E_c^0$ a new behavior is observed in which charged droplets sequentially emit a jet of the same polarity as the net charge followed by a jet of reverse polarity from the opposing side (FIG. 16*e*). The critical limit for sequential jetting is noted by the dashed curve whose specific shape remains unexplored over a wide range of q-E space.

Increasing the electric field decreases the time to form jets from both neutral and charged droplets, and the combination of net charge and higher-than-critical electric fields has a compound effect in accelerating progeny formation. Therefore the period of neutral droplet shape oscillations represents a maximum timescale for the onset of FIDI. Understanding the FIDI characteristics for a droplet of given size and charge in a specific applied field, makes it possible to apply rapidly switched fields to directly mass analyze the components of a specific droplet or a single droplet held in an electrodynamic balance.

Figure 17:
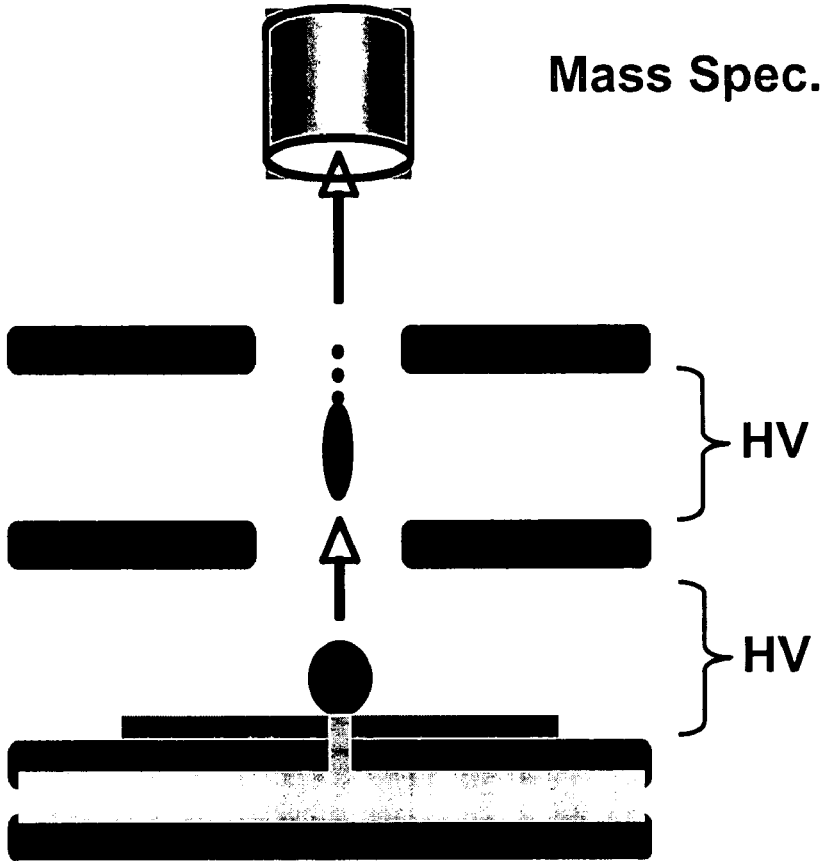
FIG. 17, provides a schematic of an apparatus including selective droplet source and an electrodynamic balance trap in accordance with another exemplary embodiment of the current invention.
Figure 18:
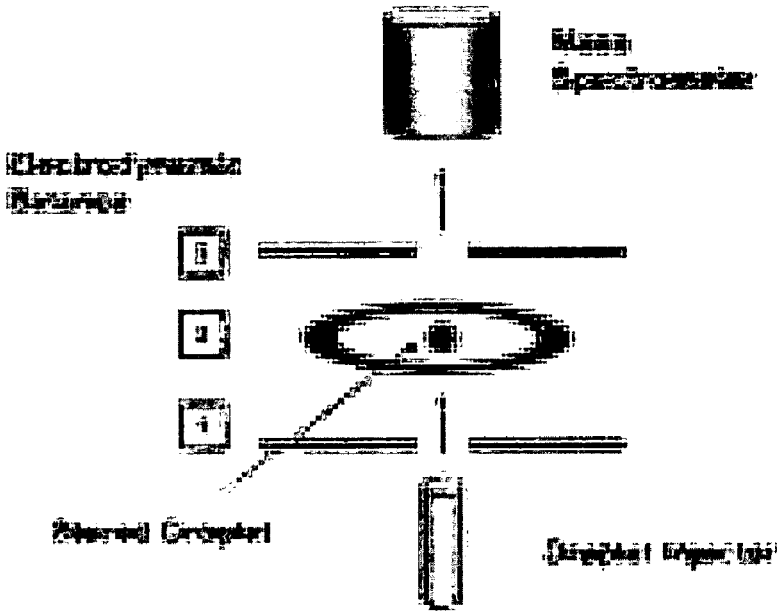
FIG. 18, provides a schematic of an apparatus including an electrodynamic balance trap in accordance with another exemplary embodiment of the current invention.

The neutral and charged droplet studies in sections 2 and 3 also suggest new methods of sampling in FIDI-MS. The minimum field necessary for neutral droplet FIDI is given by Equation (2) and the timescale of the event is predicted by Equation (10). Charged droplets develop instabilities and undergo FIDI sooner than their neutral counterparts, and increasing the applied electric field above the critical value also decreases the timescale. For example, the time needed to induce jetting and charged progeny formation from 225 μm methanol droplets is reduced by almost half when the field is raised from $E_c^0$ to 6% higher than E and the charge is increased from 0 to 0.13 $q_R$ (FIG. 15). This may be applied to analyze the composition of a specific droplet out of a larger collection selectively charged in a manner similar to flow cytometry experiments (FIG. 17), or a single charged droplet held in an EDB (FIG. 18). Takeda and co-workers recently demonstrated that electric fields lift water droplets off of a superhydrophobic surface in a process that imparts a net charge to the droplet. (See, e.g., Takeda, K.; Nakajima, A.; Hashimoto, K.; Watanabe, T. *Surf. Sci.* 2002, 519, L589, the disclosure of which is incorporated herein by reference.)

These droplets can subsequently be directed into a high-field region for FIDI-MS analysis. This technique may accordingly, be applied to sample the composition of droplets from a microfluidic device or an LC column. It should be understood that all of these sample configurations and techniques are contemplated for use with the current invention.

Discussion of FIDI-MS Apparatus

Figure 5:
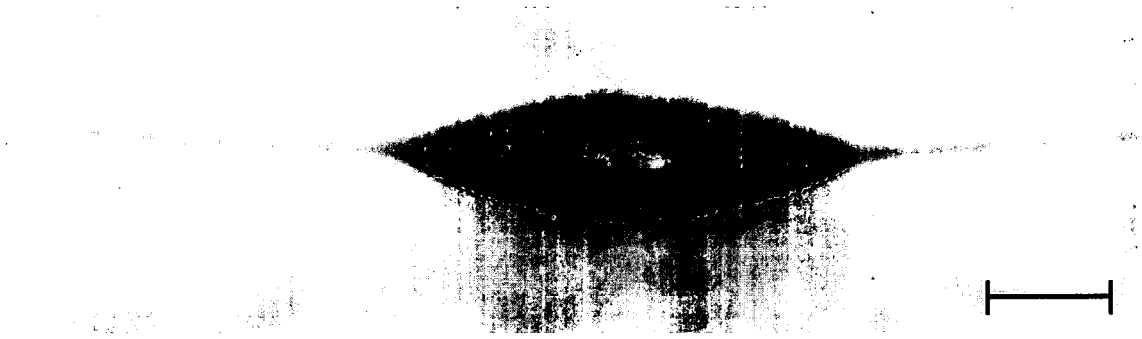
FIG. 5, provides a photographic image of a single destabilized methanol droplet subjected to a strong electric field in accordance with the current invention resulting in the formation of two opposing conical jets.
Figure 6:
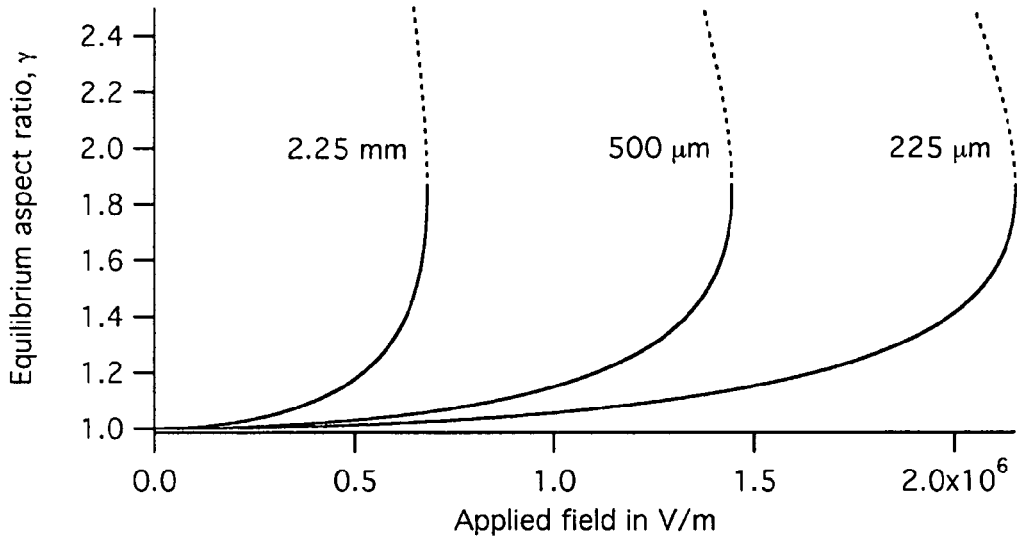
FIG. 6, provides a graph of equilibrium aspect ratio versus applied field for methanol droplets of different diameters, where the solid lines are physically attainable values for the aspect ratio whereas the dotted lines represent unstable equilibrium droplet shapes.
Figure 7:
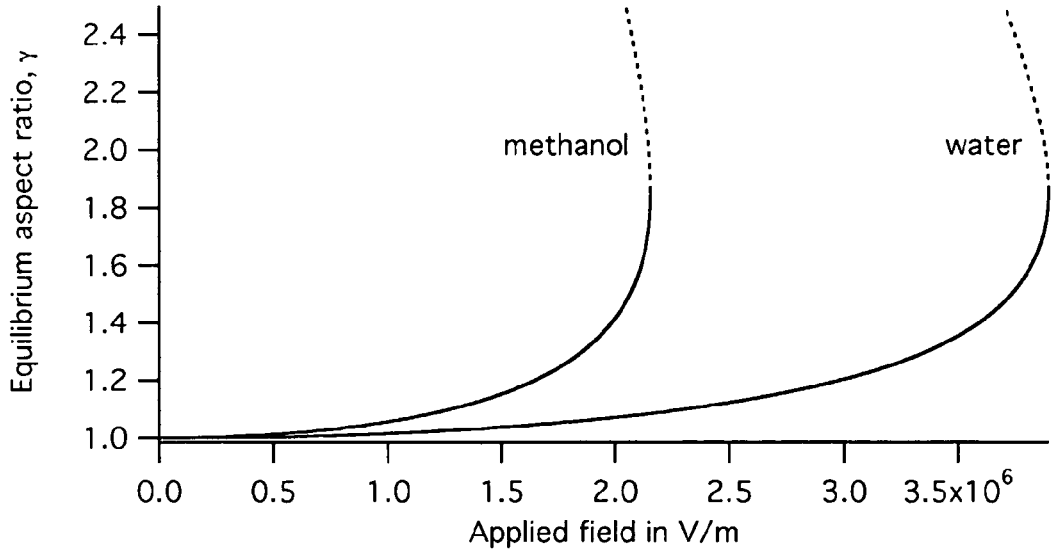
FIG. 7, provides a graph of equilibrium aspect ratio as a function of applied field for 225 μm diameter methanol and water droplets.

Controlled single or static droplet mass spectrometry (MS) is achieved through field-induced droplet ionization. A droplet is mechanically or electrically isolated between a plate electrode and the sampling capillary of an ion trap mass spectrometer. A high voltage pulse on the electrode applies a strong electric field to the droplet resulting in the ejection of jets of charged progeny droplets. A shadowgraph of a "jetting" or distorted droplet is provided in FIG. 5. The design and operation of an idealized single droplet FIDI source requires knowledge of the dynamics of the event including field strengths and the timescale over which FIDI occurs. The following discussion provides a description of the dynamics theories governing the design and operation of the technique and exemplary instruments, followed by results from experiments conducted using those exemplary devices and techniques As is discussed throughout this disclosure, field-induced droplet ionization occurs in droplets upon the application of a strong applied electric field. This field need not be constant or linear, and one embodiment of this invention is directed to techniques and devices for examining the FIDI dynamics to allow for the determination of the critical field strength and duration for a droplet of known size and bulk physical constants.

Figure 19:
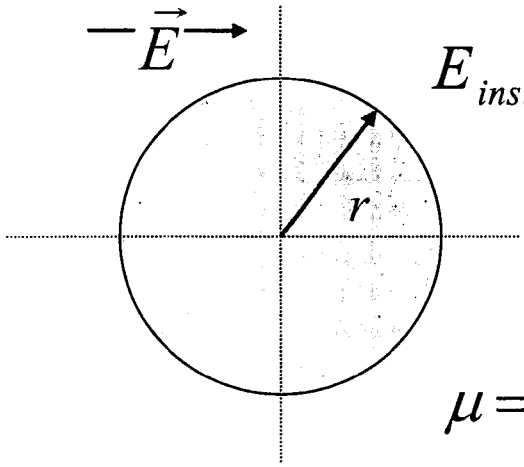
FIG. 19, provides a schematic of the physics of droplet distortion in low fields.
Figure 19:
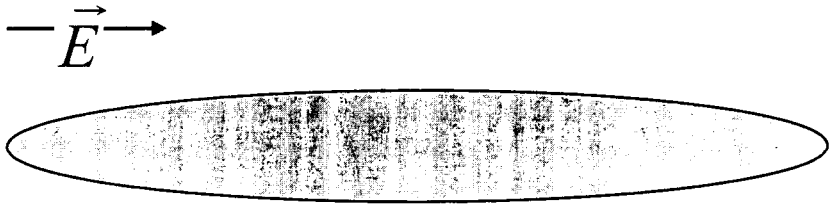
Figure 20:
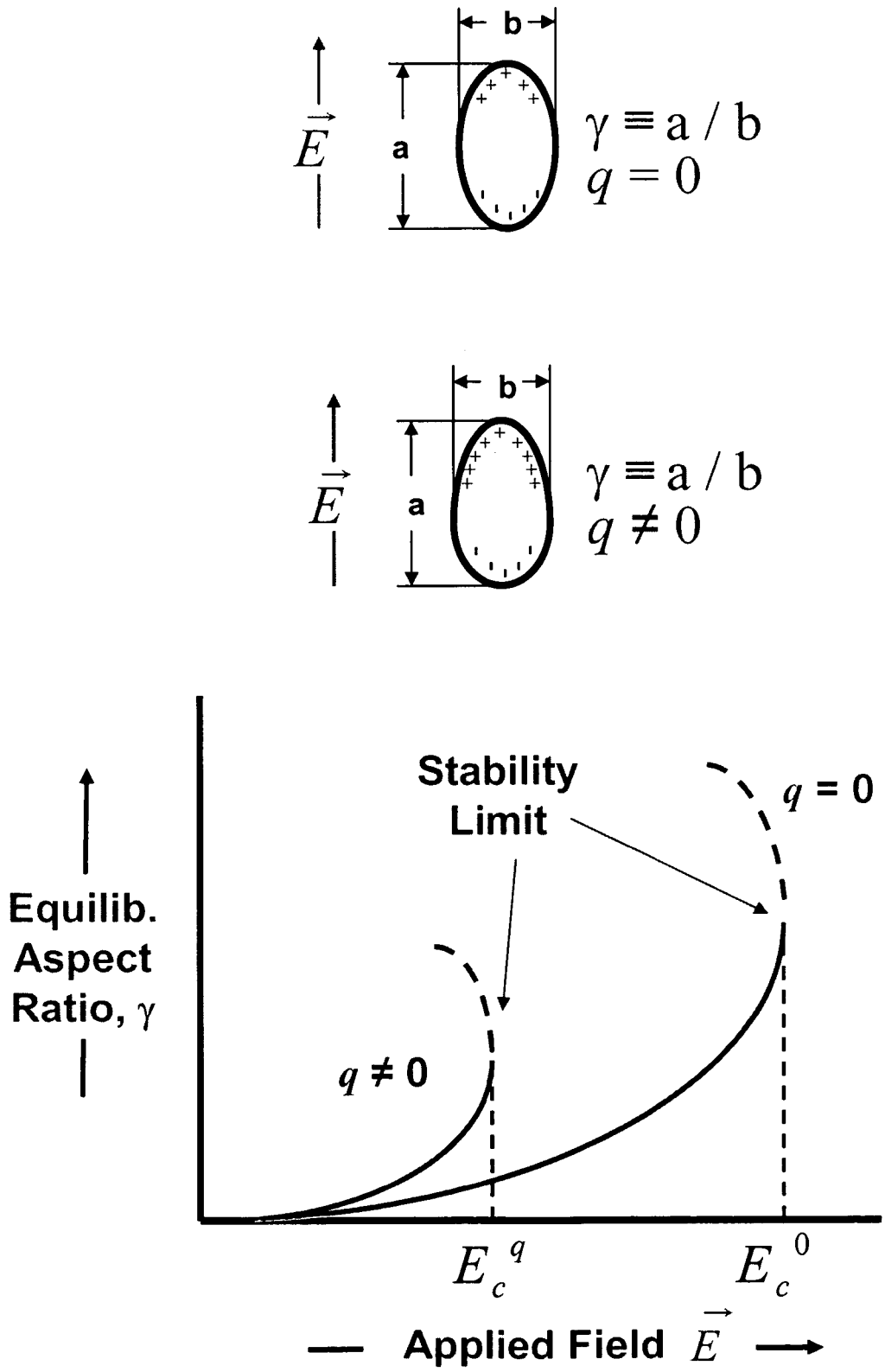
FIG. 20, provides a schematic of the physics of droplet distortion in high fields.

Schematics of the FIDI phenomenon are shown in FIGS. 19 and 20. As shown in FIG. 19, in low fields droplets remain roughly spherical. Inside the droplet the field is ~3 E/.ϵ Outside the droplet, the potential is equivalent to the applied field, E, plus the field of an electric dipole with moment μ. As the field increases, the droplets distort into prolate spheroids parallel to E and the field inside the droplet approaches the applied field. Above the Taylor limit, as shown in FIG. 20, neutral droplets develop two opposing conical tips that emit fine jets of oppositely charged progeny droplets. Below the Taylor limit, droplets undergo field-dependent shape oscillations that dampen out to an equilibrium prolate elliptical shape as predicted by Taylor. Dynamics investigations, which were presented above, demonstrate that the timescale of droplet elongation, tip formation, and progeny droplet generation slightly above the Taylor limit is related to the timescale of the oscillations slightly below the Taylor limit. In summary, it has been determined that the timescale to initiate FIDI, $\tau_{FIDI}$ is approximately 75% the time of an oscillation period, $v^{-1}$, as the applied field approaches the Taylor limit as noted by Equation (10). (See, e.g., Grimm, R. L.; Beauchamp, J. L. *J. Phys. Chem. B* 2005, 109, 8244, the disclosure of which is incorporated herein by reference.)

Thus, models of sub-critical shape oscillations become an important predictor for the timescales of FIDI. In exploring the oscillations of 225 μm methanol droplets below the Taylor limit using the current invention, it has been determined that there is good agreement between the experimental shape oscillations and the numerical model of Basaran and coworkers as well as the analytical model of Feng and Beard. Feng and Beard model the oscillation frequency $v_{FB}$ as a function of the applied field, and the droplet's natural l=2 mode oscillation shown in Equation (11). (See, e.g., Feng, J. Q.; Beard, K. V. *Proc. R. Soc. London, Ser. A* 1990, 430, 133, the disclosure of which is incorporated herein by reference.)

$$v_{FB} = \frac{8^{1/2}}{2\pi}\left[1 - 2.764E^2\left(\frac{\varepsilon_0 r}{2\sigma}\right)\right]\left(\frac{\sigma}{r^3\rho}\right)^{1/2} \tag{11}$$

The frequency decreases proportionally with $E^2$ until the Taylor limit is reached, at which point the frequency is given by Equation (12).

$$v_{FB}(E_c) = \frac{8^{1/2}}{2\pi}\left[1 - 2.764\frac{1.625^2}{8\pi}\right]\left(\frac{\sigma}{r^3\rho}\right)^{1/2} \tag{12}$$

Equations (10) and (12) may be combined into Equation (13) to show an approximate timescale for FIDI as a function of droplet size, density, and surface tension when the droplet is in a linear, homogeneous, DC electric field.

$$\tau_{FIDI} \approx 2.3\left(\frac{r^3\rho}{\sigma}\right)^{1/2} \tag{13}$$

Equations (2) and (13) are critical when designing a FIDI source. Likewise, other design factors must be considered regarding the size and separation of the electrodes that establish the electric field. When using a parallel plate capacitor configuration, the electric field is the familiar E=V/d where V is the voltage difference and d is the distance between the electrodes. If design constraints limit the maximum voltage to a value $V_{max}$, the maximum plate spacing is likewise limited to a value $d_{max}$, shown in Equation (14). Here the field necessary for FIDI from Equation (2) represents the minimum field that restricts $d_{max}$.

$$d_{\max} = \frac{2V_{\max}}{1.625}\left(\frac{\pi\varepsilon_0 r}{2\sigma}\right)^{1/2} \tag{14}$$

As expected, higher voltages afford a greater plate separation. Equation (14) also suggests the maximum plate separation increases with $r^{1/2}$ because larger droplets require lower field strengths for FIDI. Unfortunately, the dielectric breakdown limit of air and non-linear field effects also limit plate spacing. For instance, the breakdown of air is ideally ~30 kV $cm^{-1}$, however arcing often occurs at lower field strengths.

Similarly, the droplet itself will distort the electric field. These distortions may be minimized by maximizing the ratio between the plate spacing, d, and the droplet diameter, 2r, which is derived from Equation (14).

$$\frac{d_{\max}}{2r} = \frac{V_{\max}}{1.625}\left(\frac{\pi\varepsilon_0}{\sigma r}\right)^{1/2} \tag{15}$$

Although Equation (2) predicts that larger droplets require lower fields, Equation (15) shows that smaller droplets will minimize the field distortions and maximize the plate spacing to droplet size ratio proportionally with $r^{-1/2}$. Thus when designing a FIDI source, it is important to consider droplet size, $E_c$, $V_{max}$ and $\tau_{FIDI}$. The timescale is important because it determines what electric schematics are necessary for rapidly switching the electric fields. When employing linear, homogeneous DC electric fields, droplets in the micron size regime generally have FIDI timescales on the order of tens to hundreds of microseconds. At this speed high voltage solid state switching transistors are necessary to rapidly switch on and off the fields. Larger, millimeter-sized droplets have FIDI timescales on the order of milliseconds. This longer timescale allows the substitution of high voltage transistor circuits with reed relays and more modest driving and timing electronics.

In short, in the current invention a single static droplet is generated by a droplet source and held in place by a droplet positioner. The droplet serves as the "probe" for an experiment of interest, i.e., by exposure to or reaction with a sample of interest. Once the reaction or sample has been adequately probed, the droplet is controllably exposed to an electrical field strong enough to distort the droplet until a critical point at which the droplet undergoes an emission of at least one charged jet. This charged jet is directed at a charge sensitive device that permits the extractions and characterization of the charged species in the jet. In a preferred embodiment, both positive and negative ions are generated during the distortion allowing for the simultaneous characterization of both positive and negative ion components of the droplet.

Figure 21:
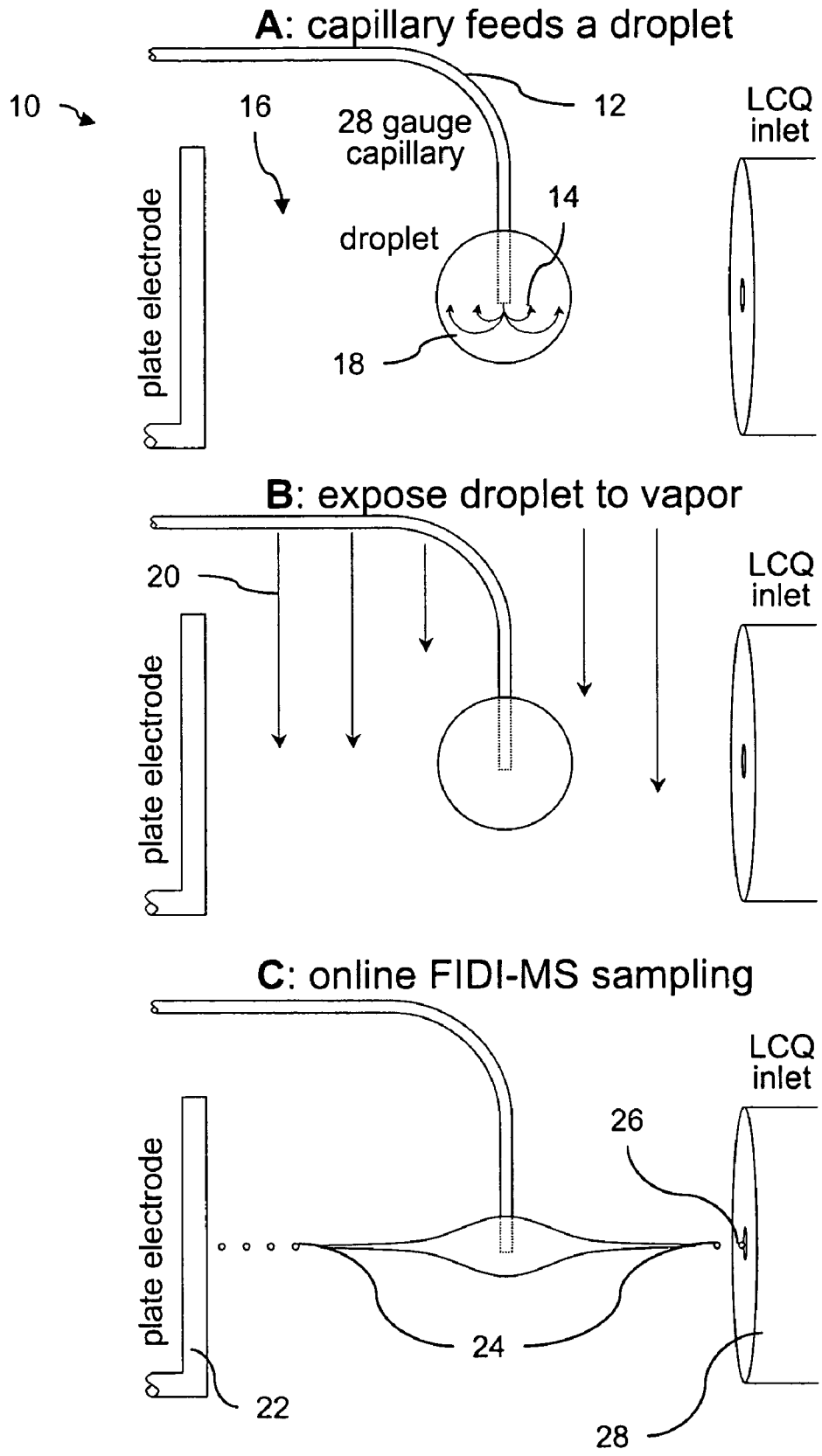
FIGS. 21*a-c*, provide schematics of an exemplary online FIDI-MS process in accordance with the current invention.

One exemplary embodiment of a static FIDI-MS apparatus (10) is provided in FIG. 21. In this embodiment, a capillary (12) feeds an analyte-containing solution (14) into an analysis area (16) forming a droplet (18) suspended from the end of that capillary (21*a*). All electrical components remain at ground as the droplet grows and reacts in a field-free environment. Reactants (20) such as aromatics or ozone may be contacted with the droplet resulting in heterogeneous reactions between the species (21*b*). Although in this embodiment the reactant is in the gas phase, it shall be understood that the reactant may be in any phase including liquids or solids that can be aborped by the droplet (18). In addition, the reactant or a reaction could be initiated after contact through, for example, photoinitation, such as by a laser directed at the probe droplet (not shown). After a suitable period of exposure to the species, a high voltage pulse on the plate electrode (22) initiates the FIDI process (21*c*). The electric field applied by the electrode distors the droplet (18) creating a series of jets (24). The charged jets enter the atmospheric sampling inlet (26) of a charged device (28) for mass analysis. To ensure proper alignment of the drop, the apparatus may also include independent three-dimensional translation stages that serve to align the droplet and the electrode, and a system to visualize the orientation of the droplet (not shown). For example in one embodiment, the apparatus would include a CCD camera, which can visualize the FIDI region reflected in a small mirror, and allow for the droplet to be oriented such that the charged progeny jets are directed into the MS capillary for mass analysis. An exemplary embodiment is shown pictorially in FIG. 22 described later.

Although the discussions above and below focus on particular embodiments of the invention, it should be understood that any suitable droplet source capable of producing a static droplet, any electrical field capable of distorting the static droplet, and any charge sensitive device capably of characterizing the charged jets formed from the distorted droplet may be used with the current invention. For example, the droplet source and positioner could be a capillary, a reservoir, or even an electrical field capable of isolating a single static droplet for analysis.

Likewise, the electrical field may be static, pulsed, or time varying depending on the arrangement of the voltages and electrodes, in order to optimize the process of droplet distortion, jetting, and ion sampling. Finally, the charge sensitive device may include any device capable of examining the ejected charged species, including a mass spectrometer, an ion mobility spectrometer or a Faraday cup.

FIDI-MS Examples

As discussed above, rapidly switched electric fields and synchronized visualization allows for the characterization of the dynamics of the FIDI process. The timescale of droplet elongation, tip formation, and progeny droplet generation slightly above $E_c^0$ is related to the timescale of the natural harmonic oscillations slightly below $E_c^0$. Equation (13) approximates the timescale for FIDI, $\tau_{FIDI}$, and is a function of bulk solution parameters including the density, $\rho$.

Understanding the critical field and the timescale for FIDI enables new applications of mass spectrometric analyses to chemical reactions occurring in small droplets. From Equation (2), it can be determined that millimeter-sized droplets generally require $1\text{-}2\times10^6$ V m$^{-1}$ fields to initiate FIDI jetting and charged progeny formation on the millisecond time scale. Therefore, using the current invention, chemical reactions within and on the droplet that occur on longer timescales may be directly probed with a rapid high voltage pulse and the ejected progeny may be characterized by mass analysis.

The following examples demonstrate the viability of the online analysis of chemical reactions within single droplets, formed on and hanging from a fine capillary, using the FIDI-MS technique of the current invention. Specifically, the following examples apply the technique to three processes between reactive gas-phase molecules and analytes dissolved in liquid droplets.

As discussed before, FIG. 21 shows a schematic of the general droplet formation, gas-phase exposure, and FIDI-MS technique used for the following examples. Initially, a 28-gauge stainless steel capillary (355 μm O.D., 178 μm I.D., Small Parts Inc.) feeds an analyte-containing solution to establish a 1-2 mm droplet (frame A). The liquid surface tension suspends the droplet on the capillary between the atmospheric sampling inlet of a ThermoFinnigan LCQ Deca mass spectrometer and a parallel plate electrode. The parallel plate electrode and the MS sampling inlet are separated by 6 mm and are bisected by the droplet. During droplet formation and reaction, the inlet, electrode, and capillary remain electrically grounded allowing reactions to proceed in a field-free environment. Heterogeneous reactions ensue with continuous vapor exposure (frame B). Reactions occur for a user-specified reaction time between 0-60 s before a high voltage pulse on the electrode applies a strong electric field to the droplet resulting in the ejection of jets of small, highly charged progeny droplets (frame C).

In the examples, the millimeter-sized droplets require millisecond fields applied by commercial high voltage reed relays (W102HVX-3, and W102VX-50, Magnecraft, Northfield, Ill.) and modest timing circuitry. The high voltage pulse establishes a $1.5\times10^6$ V m$^{-1}$, ~5 ms field to achieve jetting and FIDI as required by Equations (2) and (13). To remain field-neutral, the capillary voltage pulses to half the voltage applied to the plate electrode. When pulsed, typical voltages are 8-10 kV for the plate electrode, 4-5 kV for the capillary, and 0 V for the LCQ sampling inlet. A positive high voltage pulse directs positively charged progeny into the mass spectrometer for positive ion mass analysis and negative high voltage results in negative ion mass spectra. After FIDI-MS, flowing additional solution through the tubing causes the existing droplet to fall off and forms a fresh droplet for reaction.

Figure 22:
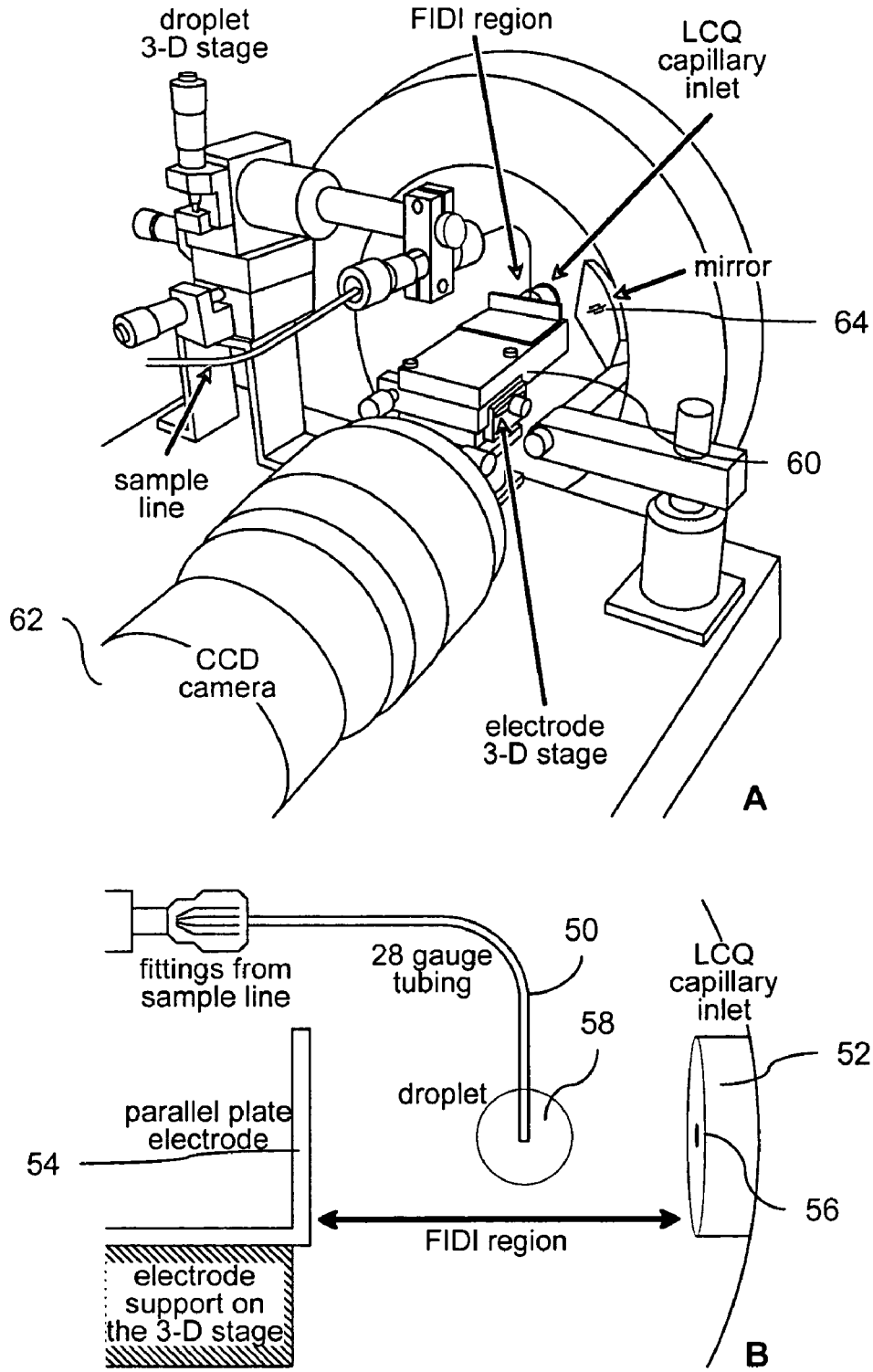
FIGS. 22*a-b*, provides a schematic of an exemplary single droplet FIDI-MS apparatus in accordance with the current invention (A), and a detailed view of the droplet positioner (B).

FIGS. 22*a* and *b*, provide schematics of the overall instrument used to conduct the exemplary experiments discussed herein. As shown, the single droplet source (50) is mounted in front of a LCQ Deca (ThermoFinnigan) ion trap mass spectrometer (52). Specifically, FIG. 22*a* shows an illustration of the apparatus mounted relative to the LCQ capillary inlet. The FIDI source consists of multiple parts which are all mounted on a 5 by 7 inch acrylic sled that sits on the rails designed for the commercial electrospray source. The FIDI region is defined by a parallel plate electrode (54) and the capillary inlet itself (56). A mechanically suspended droplet (58) bisects the field. Frame b of FIG. 22 shows this region in greater detail.

As shown in FIG. 22, the droplet hangs from a 28-gauge stainless steel tube (HTX-28-24, Small Parts, Inc.). The tube connects to a sample line and the syringe through Upchurch Scientific fittings. The solution to be analyzed is fed through the tube until a 1-2 mm diameter droplet forms at the bottom of the tube. The tube and fittings are mounted on a small three-dimensional stage (60) that adjusts to direct the progeny jets into the capillary inlet of the LCQ. The parallel plate electrode is also mounted on an independent three-dimensional stage allowing precise control of d, the spacing between the electrode and the capillary. The FIDI region is monitored with a CCD camera (62) and a mirror (64) which are each mounted on the sled. The camera allows a side-on view of the FIDI region that assists with aligning the droplet relative to the electrode and capillary and provides information on droplet size.

Droplets in this study are roughly 1-2 mm in diameter. This is an important parameter for determining the field strengths and durations needed to achieve jetting and progeny formation. At this size, Equations (2) and (13) predict $E_c$~13 kV $cm^{-1}$ and $\tau_{FIDI}$~9 ms for aqueous droplets. For a typical organic droplet where $\sigma$=0.020 N $m^{-1}$ and $\rho$=800 kg $m^{-3}$, these equations predict $E_c$~7 kV $cm^{-1}$ and $\tau_{FIDI}$~15 ms.

Under initial conditions, the capillary, tubing and electrode are maintained at electrical ground. The liquid sample is fed through the tubing to establish the proper droplet size in a field-free environment. At a user-defined point, an electric field is established using two high voltage (HV) switching circuits. The electrode voltage switches from ground to HV and the tubing voltage switches from ground to HV/2. These voltages remain for a time t~$\tau$ before returning to ground. Throughout this time, the capillary remains at electrical ground. Typically HV=7-9 kV and HV/2=3.5-4.5 kV. When sampling positively charged droplets into the mass spectrometer for a positive ion mass spectrum, both HV and HV/2 deliver positive voltage. Conversely, negative high voltage settings direct negatively charged progeny into the instrument for a negative ion mass spectrum. Following the time t, the electrode and hypodermic tube return to electrical ground. The parent droplet remains mechanically suspended and may be sampled by FIDI repeatedly until the volume of the droplet decreases such that the applied field is below the Taylor limit given by Equation (2).

The millisecond timescales required for FIDI of 1-2 mm droplets simplifies the electronic circuits. Previous investigations on the dynamics of jetting and progeny formation focused on the behavior of 225 μm diameter methanol droplets. For these droplets, FIDI timescales are between 400 and 700 μs depending on the applied field strength. Such timescales require custom circuitry and high-voltage MOSFET switches to achieve rapid (≦1 μs) switching of the high voltage. In the case of 1-2 mm droplets, solid state switching circuitry may be replaced with commercial high voltage reed relays.

For the reaction between naphthalene and silver ions, naphthalene-saturated air at 353K (99%, Sigma, 0.87 Torr partial pressure, from Yaws, C. L. *Chemical Properties Handbook Physical, Thermodynamic, Environmental, Transport, Safety, And Health Related Properties for Organic and Inorganic Chemicals*; McGraw-Hill: New York, 1999, the disclosure of which is incorporated herein by reference) continually flows through the FIDI region at 500 mL $min^{-1}$. A solution of 100 μM silver nitrate (ACS reagent, 99.9+%, Alfa Aesar) in 20% water and 80% methanol is used to form the droplets. Simultaneously, a +9.0 kV, 6 ms pulse on the plate electrode and a +4.5 kV, 6 ms pulse on the capillary establishes a $1.5\times10^6$ V $m^{-1}$ field that initiates FIDI following reaction times between 0 and 30 s. Positively charged progeny droplets are directed into the LCQ which is set to positive ion mode.

For the ozonolysis reactions, a pencil-style UV calibration lamp (model 6035, Oriel) generates ~75 ppb ozone in air that continually washes through the FIDI region at 500 mL $min^{-1}$. Either 10 μM oleic acid (>99.0%, Fluka) or 100 μM oleoyl-L-α-lysophosphatidic acid, (commonly referred to as LPA (18:1), sodium salt, 98%, Sigma) solutions in 90% dimethyl formamide (DMF) and 10% methanol feed the droplet source. DMF is employed because it has low vapor pressure and an evaporation rate similar to water. However, because $E_{FIDI}\propto\sigma^{1/2}$, the comparatively low surface tension of DMF allows more modest fields than required for water droplets of the same size. The low vapor pressure and slow evaporation rate results in a negligible size decrease over the maximum 60 s timescale of the ozonolysis experiments. The −9.2 kV and −4.6 kV, 6 ms pulses to the plate electrode and capillary initiate FIDI and direct negatively charged progeny into the LCQ for negative ion mass analysis.

Resistance models commonly explain chemistry between gas- and solution-phase species. (See, e.g., Finlayson-Pitts, B. J.; Pitts Jr., J. N. *Chemistry of the Upper and Lower Atmosphere: Theory, Experiments, and Applications*; Academic Press: San Diego, 2000, the disclosure of which is incorporated herein by reference.) Such models break overall heterogeneous reactions into a series of steps such as gas diffusion to the droplet surface, surface accommodation and reaction, diffusion through the solution-phase, and reactions in the solution. In developing these models, gas-phase reactants have a characteristic penetration distance within a droplet due to diffusion before reaction. This characteristic penetration distance, l, is commonly referred to as the diffuso-reactive length and is given by Equation (16) for the penetration of ozone into an oleic acid-containing droplet. (See, e.g., Smith, G. D.; Woods, E.; DeForest, C. L.; Baer, T.; Miller, R. E. *J. Phys. Chem. A* 2002, 106, 8085-8095, the disclosure of which is incorporated herein by reference.)

$$l=\left(\frac{D}{k_2[\text{Oleic Acid}]}\right)^{1/2} \tag{16}$$

In Equation (16), D represents the diffusion constant of ozone in the liquid and is commonly approximated by $1.5\times10^{-5}$ $cm^2$ $s^{-1}$, the diffusion constant of molecular oxygen in common organic solvents. The initial concentration of oleic acid is 10 μM, and the bulk ozonolysis rate constant, $k_2$~$1\times10^6$ $M^{-1}$ $s^{-1}$.

This predicts that ozone characteristically penetrates ~10 μm into the 1-2 mm droplets in this study. Reactions occur in the outer 1% of the droplet diameter, which supports the presence of interfacial chemistry. In the environment, only fine (<2.5 μm diameter, $PM_{2.5}$) and coarse (<10 μm diameter, $PM_{10}$) particulate matter have lifetimes long enough for reaction chemistry to occur. Therefore at this concentration of oleic acid, the ozonolysis reactions being probed in this study would model bulk-phase processes within atmospherically-relevant aerosol droplets.

To confirm peak assignments in the FIDI-MS spectra, commercially acquired samples of the expected ozonolysis reaction products are electrosprayed into the LCQ. Peaks in the FIDI-MS and ESI-MS spectra are compared as well the peak distributions from collision-induced dissociation (CID) spectra. Nonanoic acid (>99.5%, Fluka), azelaic acid (>99.0%, Fluka), and 9-oxononanoic acid (5 mg in ethanol, Indofine Chemicals) are used without further purification. Tunable LCQ instrument parameters remain identical for both the FIDI and electrospray experiments.

Naphthalene and Silver Ions

Complexation between the polycyclic aromatic hydrocarbon naphthalene and solution-phase silver ions demonstrates the capability of the current technique and apparatus to adsorp gas-phase organics into the droplets for analysis. Naphthalene ions do not traditionally appear in mass spectra from soft ionization sources such as electrospray (ESI) and FIDI. However, naphthalene forms complexes with metal ions that are preserved by soft-ionization techniques. Silver ions from dissolved silver nitrate are employed because of the characteristic isotope pattern at 107 and 109 m/z in nearly equal ratio.

Figure 23:
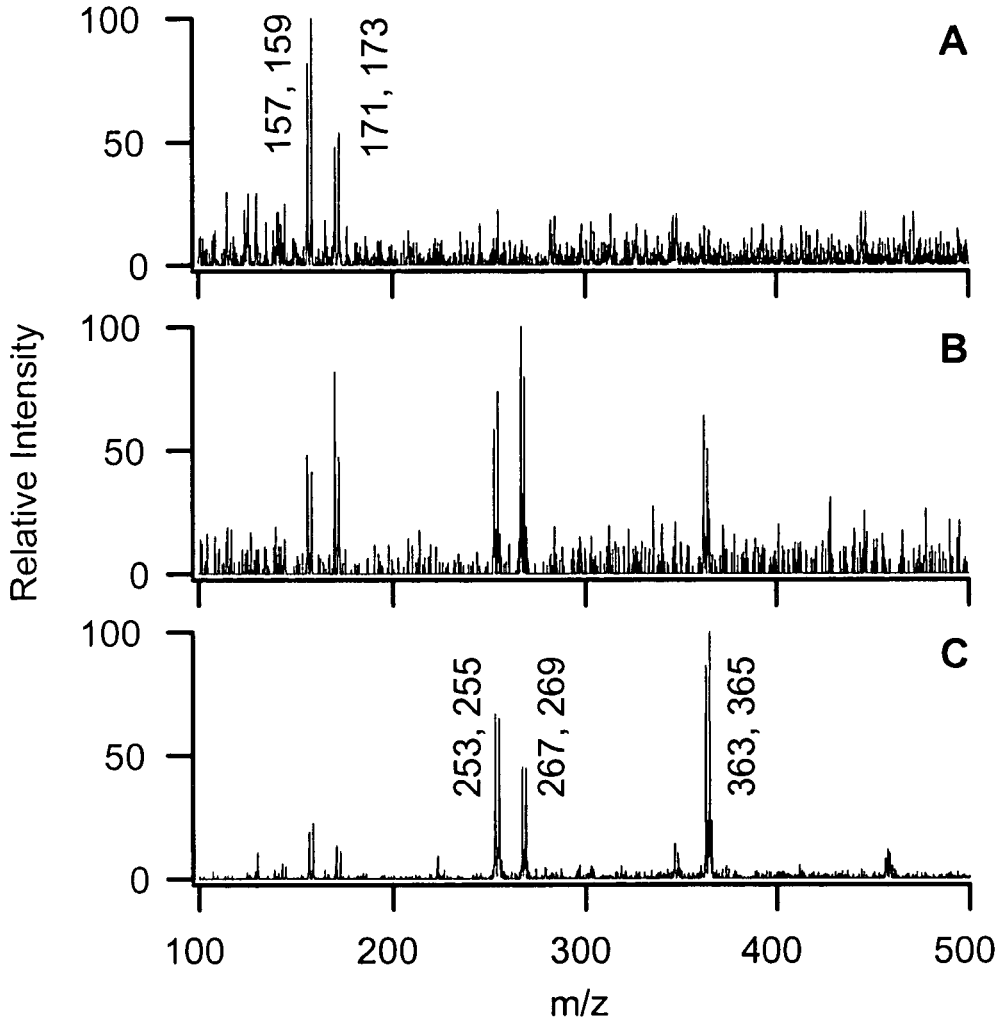
FIGS. 23*a-c*, provide positive ion spectra for (A) <1 s, (B) 10 s, and (C) 30 s exposures to naphthalene before beings sampled by FIDI-MS.

FIG. 23 shows the positive ion spectrum for (a) <1 s, (b) 10 s, and (c) 30 s exposures to naphthalene before beings sampled by FIDI-MS. When the droplet undergoes FIDI-MS immediately following formation (frame a), $Ag^+(H_2O)(MeOH)$ complexes at 157 and 159 m/z and $Ag^+(MeOH)_2$ complexes at 171 and 173 m/z dominate the spectrum. Following a 10 s exposure to naphthalene vapor (frame b), spectra show a distribution of the reactant clusters as well as naphthalene monomer adducts at 253 and 255 m/z due to $Ag^+(H_2O)$(naphthalene) and at 267 and 269 m/z due to $Ag^+(MeOH)$(naphthalene). Frame b also shows the formation of a naphthalene dimer-silver cation complex at 363 and 365 m/z. After a 30 s exposure (frame c), the dimer complex dominates the spectrum.

Ozone and Oleic Acid

Researchers consider the reaction of gas-phase ozone with oleic acid as a model system for heterogeneous reaction chemistry, with significant implications for atmospheric chemistry. (See, e.g., Hung, H. M.; Katrib, Y.; Martin, S. T. *J. Phys. Chem. A* 2005, 109, 4517-4530; Knopf, D. A.; Anthony, L. M.; Bertram, A. K. *J. Phys. Chem. A* 2005, 109, 5579-5589; Katrib, Y.; Martin, S. T.; Hung, H. M.; Rudich, Y.; Zhang, H. Z.; Slowik, J. G.; Davidovits, P.; Jayne, J. T.; Worsnop, D. R. *J. Phys. Chem. A* 2004, 108, 6686-6695; Smith, G. D.; Woods, E.; DeForest, C. L.; Baer, T.; Miller, R. E. *J. Phys. Chem. A* 2002, 106, 8085-8095; Moise, T.; Rudich, Y. *J. Phys. Chem. A* 2002, 106, 6469-6476; and Hearn, J. D.; Smith, G. D. *J. Phys. Chem. A* 2004, 108, 10019-10029, the disclosures of which are incorporated herein by reference. Cooking involving animal and vegetable oils is a significant source of atmospheric oleic acid and environmental field measurements suggest oleic acid is present in ng $m^{-3}$ concentrations in urban areas with a lifetime on the order of days. (See, Rogge, W. F.; Hildemann, L. M.; Mazurek, M. A.; Cass, G. R.; Simonelt, B. R. T. *Environ. Sci. Technol.* 1991, 25, 1112-1125; and Morris, J. W.; Davidovits, P.; Jayne, J. T.; Jimenez, J. L.; Shi, Q.; Kolb, C. E.; Worsnop, D. R.; Barney, W. S.; Cass, G. *Geophys. Res. Lett.* 2002, 29, art. no. 1357, the disclosures of which are incorporated herein by reference. Ziemann presents a rigorous mechanism of pure oleic acid ozonolysis. (See, Ziemann, P. J. *Faraday Discuss.* 2005, 139, 469-490, the disclosure of which is incorporated herein by reference.)

Scheme 1 details a simplified version of this mechanism showing the important intermediates and expected reaction products. Briefly, ozone adds across the oleic acid (1) double bond forming a primary ozonide (2). This energetic ozonide dissociates either into Crigee intermediate (3') and nonanal (4) or into 9-oxonanoic acid (5) and intermediate (6'). These excited intermediates may isomerize into azelaic acid (3) or nonanoic acid (6), respectively. Alternatively, the intermediates may recombine with their respective aldehydes to form a secondary ozonide (7) which will also dissociate to give products (3)-(6). (see, e.g., Wadia, Y.; Tobias, D. J.; Stafford, R.; Finlayson-Pitts, B. J. *Langmuir* 2000, 16, 9321-9330, the disclosure of which is incorporated herein by reference.) The presence of an inert solvent and the absence of further reactive species minimize other products formed though reactions involving the Crigee intermediates. The micromolar concentrations of oleic acid employed our experiments allow for this simplification. The short (~10 nm) characteristic diffusion distance of ozone into pure oleic acid supports the model of a heterogeneous reaction at the air-droplet interface. This reaction is well-studied but questions remain regarding the partitioning of products and the relative yields from the ozonolysis in Scheme 1. Katrib and co-workers summarize recent experiments that suggest nonanal partitions into the vapor phase and would not be detected by FIDI-MS of the droplet. They find the formation of 9-oxononanoic acid dominates the products relative to only small quantities of nonanoic acid and azelaic acid. (See, Katrib, Y.; Martin, S. T.; Hung, H. M.; Rudich, Y.; Zhang, H. Z.; Slowik, J. G.; Davidovits, P.; Jayne, J. T.; Worsnop, D. R. *J. Phys. Chem. A* 2004, 108, 6686-6695, cited above.)

Because ozone preferentially attacks organic molecules at carbon-carbon double bonds with few rearrangements, ozonolysis products have a predictable mass based on the reaction shown in Scheme 1. Therefore, the product ion mass may be employed to localize the position of a double bond within a reactant organic molecule. For example, Privett and Nickell demonstrate double bond localization by ozonolysis with subsequent product analysis by gas chromatography. (See, Privett, O. S.; Nickell, E. C. *Lipids* 1966, 1, 98-103, the disclosure of which is incorporated herein by reference.) Ozonolysis is one of many chemical derivatization techniques including hydrazine reduction, silylation, and epoxidaion, which react to break the double bond but maintain the remaining structural information. (See, e.g., Roehm, J. N.; Privett, O. S. *J. Lipid Res.* 1969, 10, 245-7; Ariga, T.; Araki, E.; Murata, T. *Anal. Biochem.* 1977, 83, 474-483; and Tumlinson, J. H.; Heath, R. P.; Doolittle, R. E. *Anal. Chem.* 1974, 46, 1309-1312, the disclosures of which are incorporated herein by reference.)

SCHEME 1:

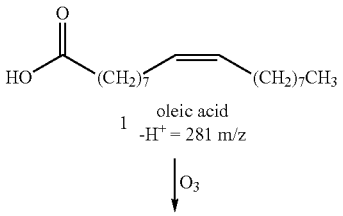

-continued

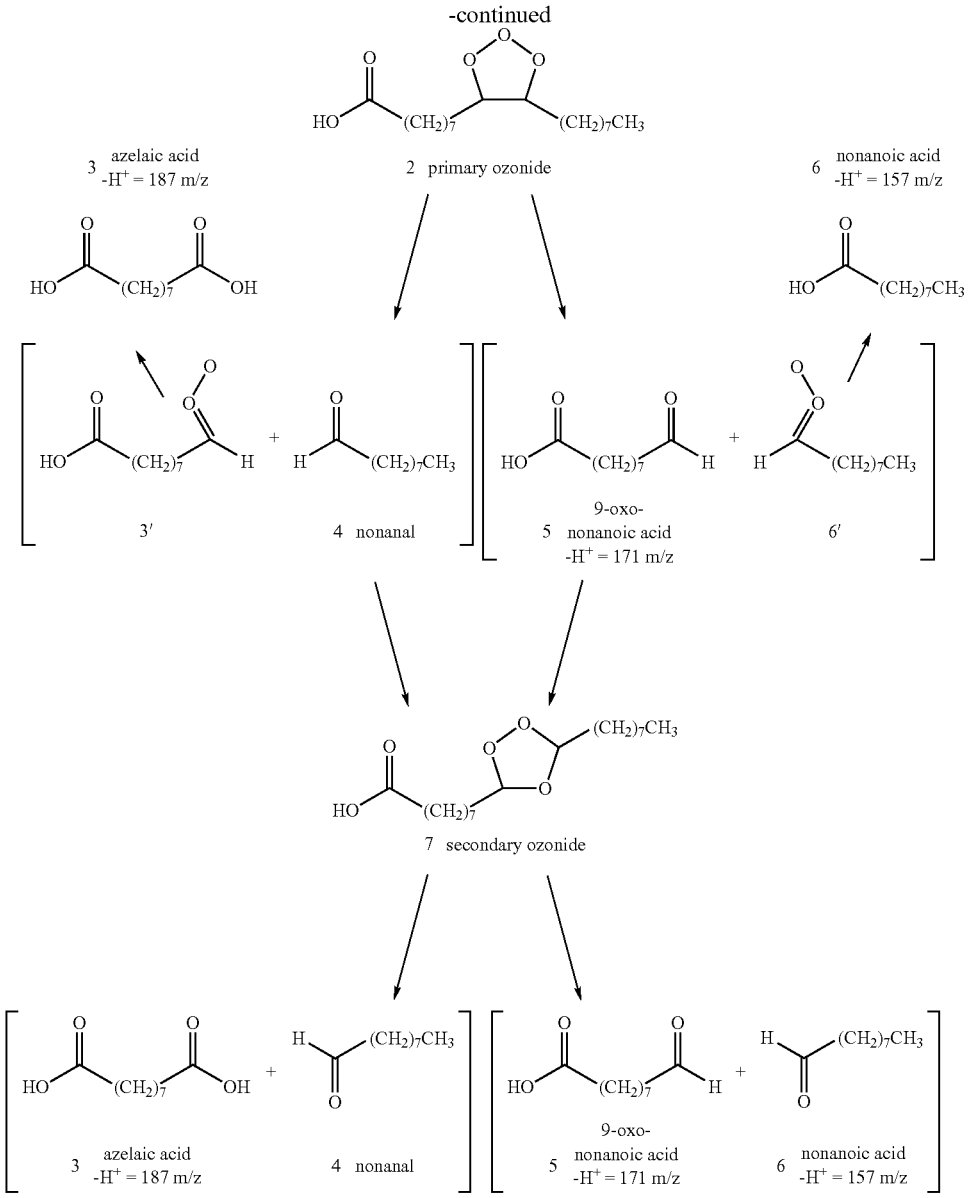

Early high-resolution MS studies characterize the reaction of olefins with $Ti^+$, and $Co^+$. Gross and co-workers apply similar reaction chemistry to localize double bonds in large olefins using $Fe^+$, and $Cu^+$. (See, e.g., Allison, J.; Ridge, D. P. *J. Am. Chem. Soc.* 1977, 99, 35-39; Armentrout, P. B.; Halle, L. F.; Beauchamp, J. L. *J. Am. Chem. Soc.* 1981, 103, 6624-6628; Peake, D. A.; Gross, M. L.; Ridge, D. P. *J. Am. Chem. Soc.* 1984, 106, 4307-4316; Peake, D. A.; Gross, M. L. *Anal. Chem.* 1985, 57, 115-120; and Peake, D. A.; Gross, M. L. *J. Am. Chem. Soc.* 1987, 109, 600-602, the disclosures of which are incorporated herein by reference.) In general, double bond determination by ozonolysis requires separate reaction and characterization steps that may be simplified using online FIDI-MS or ESI-MS. Thomas and co-workers recently demonstrated ozonolysis of phospholipids directly within an electrospray ionization plume. (See, e.g., Thomas, M. C.; Mitchell, T. W.; Blanksby, S. J. *J. Am. Chem. Soc.* 2006, 128, 58-59, the disclosure of which is incorporated herein by reference.)

Figure 24:
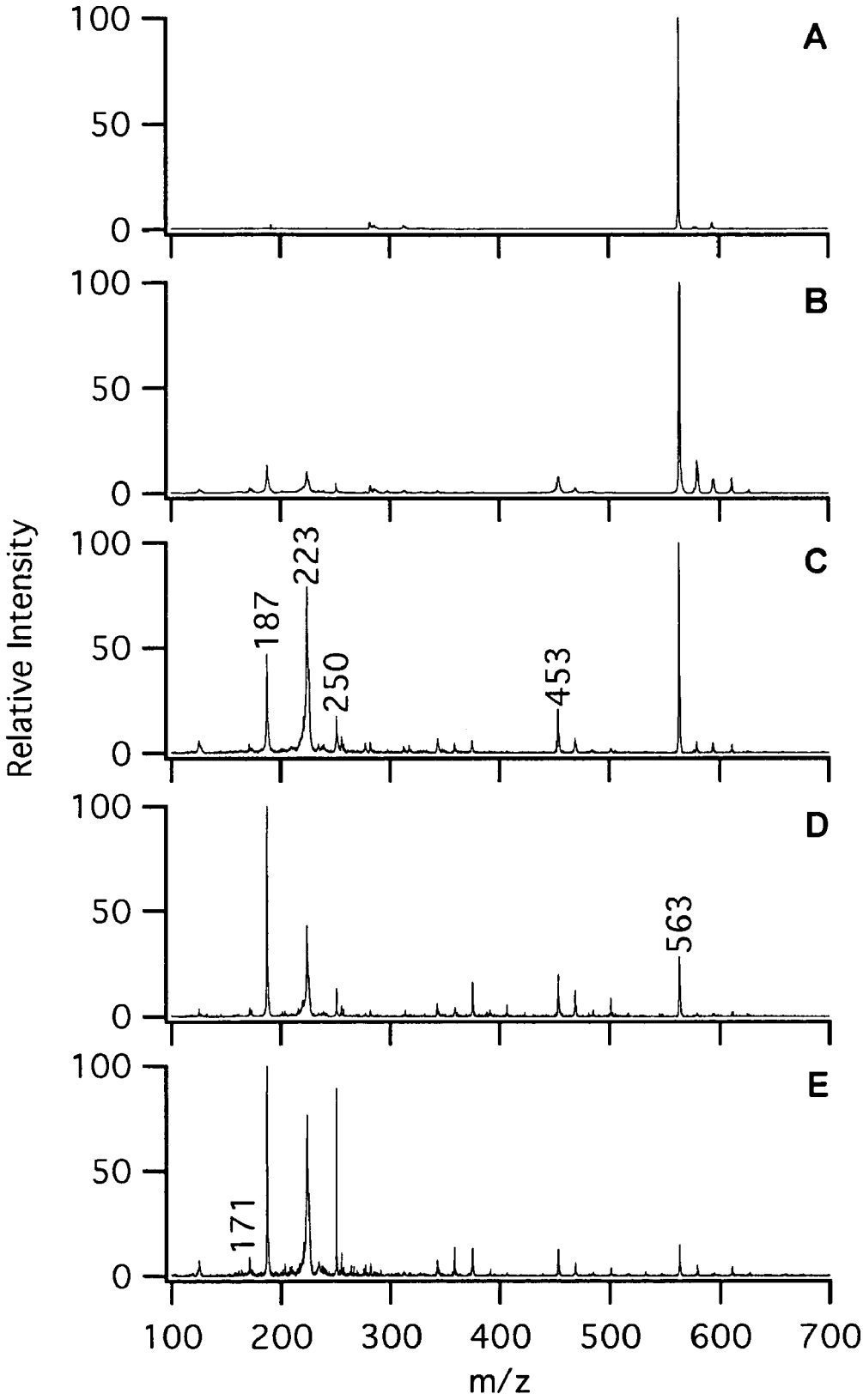
FIGS. 24*a-e*, provide positive ion spectra for the oxidation of oleic acid by ozone as a function of time. Successive frames show reaction with (B) <1 s, (C) 5 s, (D) 20 s, (E) 60 s, exposures.

FIG. 24 shows the negative ion FIDI-MS spectra for the ozonolysis of oleic acid. The singly deprotonated dimer at 563 m/z dominates the FIDI-MS spectrum of oleic acid in the absence of ozone (frame a) as well as the electrospray spectrum of the same solution (not shown). Frames (b)-(e) show increasing relative concentrations of the products to reactants (563 m/z) after instantaneous (<1 s), 5 s, 20 s, and 60 s exposures to ozone, respectively. Principle reaction products include deprotonated azelaic acid (3), at 187 m/z, and cluster ion peaks containing azelaic acid at 223 m/z and 250 m/z (discussed later). Collision-induced dissociation CID reactions of the 187 m/z ion are identical to CID electrospray mass spectra from the commercially supplied azelaic acid. The 9-oxononanoic acid (5), is principally observed as a singly deprotonated complex with oleic acid at 453 m/z. CID of the 453 m/z ion yields both the 171 m/z and 281 m/z ions characteristic of deprotonated 9-oxononanoic acid and oleic acid, respectively. After 60 s, spectra show a small quantity of deprotonated 9-oxononanoic acid at 171 m/z. Deprotonated nonanoic acid (6) is not observed as expected at 157 m/z in any of the spectra.

Low energy CID spectra of the 223 m/z and 250 m/z ions principally produce singly deprotonated azelaic acid indicating cluster parent ions. The peak at 223 m/z can be attributed to a deprotonated cluster of azelaic acid and two water molecules. CID of the 223 m/z peak reveals azelaic acid at 187 m/z but virtually no signal at 205 m/z which would correspond to a deprotonated cluster of azelaic acid and one water molecule. This behavior is also observed in the electrospray spectrum of azelaic acid in DMF with 0.1% water. Although water is not a principal component of the reactant solution, density functional theory calculations performed with CaCHe indicate exceptionally strong binding in doubly hydrated, deprotonated azelaic acid. Although not to be bound by theory, it is possible that a ring complex is formed in which doubly deprotonated azelaic acid forms four hydrogen bonds to the outer protons of the proton-bound water dimer in a Zundel-like water cluster. The stability of this cluster and the soft ionization process characteristic of FIDI suggest that the deprotonated azelaic acid may complex to trace water impurities in the original solution or water within the mass spectrometer ion trap. CID of the 250 m/z peak reveals azelaic acid at 187 m/z. This peak may be due to a deprotonated cluster of azelaic acid and nitric acid (63 Da), however the ESI-MS of azelaic acid in DMF with 0.1% nitric acid did not reveal this cluster.

In general, the sum of the product ion peak intensities due to azelaic acid and its complexes is 5 to 25 times the sum of the overall intensity of peaks due to 9-oxononanoic acid and its clusters. However, comparison of the product peak intensities and with the ozonolysis scheme requires an understanding of the overall relative ionization and detection efficiencies in the mass spectrometer. When electrosprayed into the mass spectrometer under otherwise identical instrument parameters, a 10 μM equimolar mixture of 9-oxononanoic acid and azelaic acid shows a peak ratio of ~1:10. This indicates ozonolysis is producing roughly equal amounts of azelaic acid and 9-oxonanoic acid. This result contrasts with previous studies on pure oleic acid droplets that find more than a 5-fold excess of 9-oxonanoic acid over azelaic acid. As discussed in the introduction, Scheme 1 presents a simplified mechanism that does not show additional ozonolysis products such as diperoxides and oligomers that give rise to additional sources of 9-oxonanoic acid. (See, e.g., Ziemann, P. J. *Faraday Discuss.* 2005, 139, 469-490, the disclosure of which is incorporated herein by reference.) These reaction pathways depend on the olefin concentration. (See, e.g., Bailey, P. S. *Ozonation In Organic Chemistry: Volume* 1 *Olefinic Compounds*; Academic Press: New York, 1978, the disclosure of which is incorporated herein by reference.) The low concentration of oleic acid in the present experiments minimizes these alternate pathways, which in turn maximizes the formation of the secondary ozonide (7) and products (3)-(6). The roughly equal concentrations of azelaic acid and 9-oxonanoic acid produced in this study support the suppression of alternate reaction pathways and equal preference in the dissociation of the ozonides.

Interestingly, a 10 μM equimolar electrospray mass spectrum of nonanoic acid and 9-oxononanoic acid shows a peak ratio of ~2:3 yet no nonanoic acid is observed in the FIDI ozonolysis experiments. According to Scheme 1, formation of nonanoic acid is concurrent with formation of 9-oxononanoic acid. This indicates the ratio of nonanoic acid to 9-oxononanoic acid in the ozonolysis experiment should be similar to the intensity ratio in the equimolar electrospray. Peaks due to nonanal are not expected because negative ion soft-sampling produces poor signal from aldehydes and previous research shows nonanal partitioning into the vapor phase. (See, e.g., Katrib, Y.; Martin, S. T.; Hung, H. M.; Rudich, Y.; Zhang, H. Z.; Slowik, J. G.; Davidovits, P.; Jayne, J. T.; Worsnop, D. R. *J. Phys. Chem. A* 2004, 108, 6686-6695; and Moise, T.; Rudich, Y. *J. Phys. Chem. A* 2002, 106, 6469-6476, the disclosures of which are incorporated herein by reference.)

Ozone and LPA (18:1)

The FIDI-MS study of oleic acid demonstrates the viability of online FIDI-MS for double bond localization with the reaction between ozone and LPA (18:1). Scheme 2 shows LPA (18:1) (8), and the expected aldehyde (9), and acid (10), reaction products based on the known oleic acid reaction with ozone. Additionally, the Crigee intermediate may react with methanol forming an α-methoxyhydroperoxide (11). (See, Gbara-Haj-Yahia, I.; Zvilichovsky, G.; Seri, N. *J. Org. Chem* 2004, 69, 4135-4139, the disclosure of which is incorporated herein by reference.)

SCHEME 2:

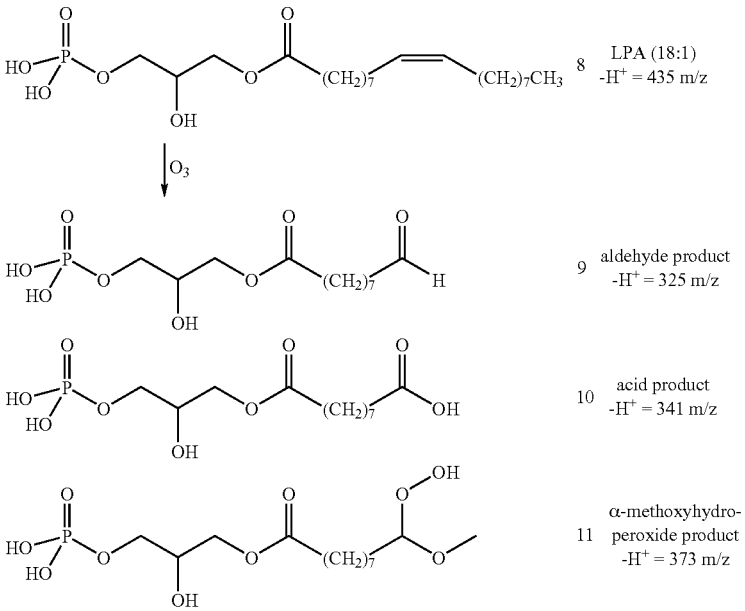

Figure 25:
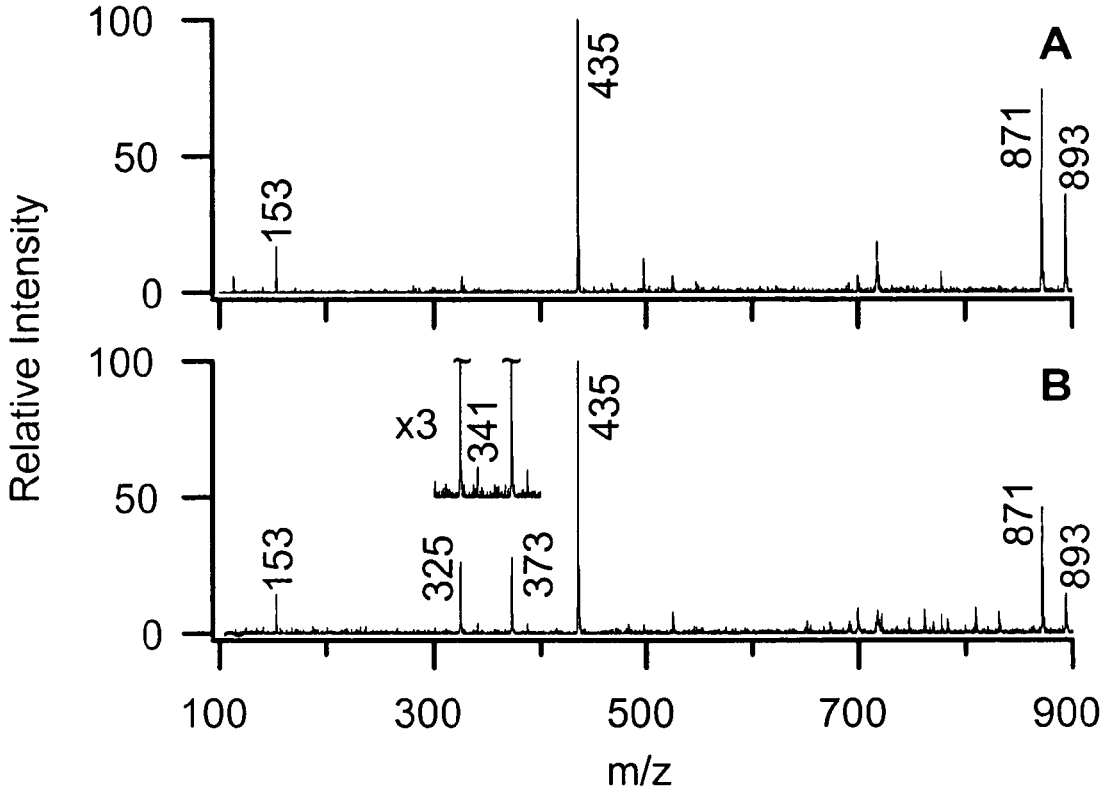
FIGS. 25*a* & *b*, provide positive ion spectra for the oxidation of LPA (18:1) by ozone in the absence of ozone (A), and following 5 second exposures to ozone (B).

Based on the predicted pathways outlined and experimentally observed peaks supporting Scheme 1, the primary ozonolysis products are directly related to the structure of the original reactant. FIG. 25*a* shows the negative ion FIDI-MS spectrum of LPA (18:1) in the absence of ozone. Primary peaks are due to deprotonated LPA (18:1) at 453 m/z, a deprotonated dimer at 871 m/z, a doubly deprotonated sodium-bound adduct at 893 m/z, and a deprotonated ester hydrolysis product at 153 m/z. FIG. 25*b* shows the FIDI-MS spectrum for droplets exposed to ozone for 5 s. This reaction time was selected based on the oleic acid results which showed significant amounts of both reactant and product ion signal after 5 seconds of ozone exposure (FIG. 24*c*). Product ions include strong peaks at 325 and 373 m/z, and a very weak signal at 341 m/z (magnified in the FIG. 25*b* inset). The deprotonated reaction products at 325 m/z and 341 m/z respectively correspond to the formation of an aldehyde and an organic acid at the 9th carbon atom in the ester in support of Scheme 2. This is indeed the location of the double bond in LPA (18:1) indicating that FIDI-MS successfully localizes double bonds and characterizes the reaction products with a soft-sampling ionization method. The peak at 373 m/z is likely an α-methoxyhydroperoxide species (11) formed by the reaction of the Crigee intermediate with a methanol solvent molecule. Thomas and coworkers observe similar species in the mass analysis of phospholipids oxidized within an electrospray ionization plume. (See, e.g., Thomas, M. C.; Mitchell, T. W.; Blanksby, S. J. *J. Am. Chem. Soc.* 2006, 128, 58-59, the disclosure of which is incorporated herein by reference.) Considering the relative intensities of the 341 and 373 m/z ions, the α-methoxyhydroperoxide product likely constitutes the dominant reaction pathway of the Crigee intermediate in this experiment resulting a low relative concentration of the acid (10).

SUMMARY

Capillary-suspended 1-2 mm diameter droplets undergo heterogeneous reactions between solution phase analytes and gas-phase species. Reactions occur for a specified time before an applied strong electric induces FIDI and the production of charged progeny that are characterized by mass spectrometry. The technique is applied to three chemical systems. The adsorption of naphthalene into silver ion-containing droplets is demonstrated by the formation of silver-ion-naphthalene adducts. Ozonolysis of droplets containing oleic acid produces 9-oxononanoic acid and azelaic acid in similar concentrations. Products from the ozonolysis of LPA (18:1) unambiguously demonstrate the double bond position in the original phosopholipid. Each of these organic acids contains a carbon-carbon double bond that reacts with ozone in a heterogeneous reaction. When sampled at multiple reaction lengths, the ozone/oleic acid products show a successively increasing ratio between products and reactants indicating that FIDI-MS is a viable technique for kinetic studies of heterogeneous reactions in microdroplets. Reactions between ozone and LPA produce species that unambiguously and correctly localize the position of the double bond along the hydrocarbon chain.

In summary, the above examples show that the inventive FIDI-MS technique allows for real-time monitoring of the reaction chemistry in single droplets. Such reactions may include environmental studies involving online characterization of the kinetics of heterogeneous reactions between gas-phase and solution-phase species, and solution-phase photo-initiated reactions whose products are sampled by FIDI-MS after a predetermined reaction time. The applications may also be extended to include the examination of other static sources of droplets or those suspended in an electrodynamic balance or by acoustic levitation.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A chemical analysis probe apparatus comprising:

a droplet source in fluid communication with a probe liquid reservoir, the droplet source having an outlet where a droplet of probe liquid is produced;

a droplet positioner for holding and maintaining the droplet in a stationary position during analysis;

a target material source being disposed such that a target material can be brought into contact with the probe liquid droplet;

an electrical field generator disposed such that the probe liquid droplet is exposed to the field, the electrical field having a field strength sufficient to create a distortion within the probe liquid droplet, the distortion forming at least one jet of material that separates from the probe liquid droplet; and a mass detector having a detector opening, the mass detector being disposed such that the jet of material is directed through the opening into the mass detector.

2. The apparatus as described in claim 1, wherein the droplet source is a capillary, and wherein the droplet positioner is the outlet of the capillary, whereat the droplet is formed and held for analysis.

3. The apparatus as described in claim 1, wherein the droplet source is an injector, and the droplet positoner is an electrodynamic balance trap.

4. The apparatus as described in claim 1, wherein the droplet source is a super hydrophobic surface, and wherein the droplet positioner is an electric field for lifting the droplet into an electrodynamic trap.

5. The apparatus as described in claim 1, wherein the electric field is selected from the group consisting of static, pulsed, and oscillating.

6. The apparatus as described in claim 1, wherein the droplet is neutral and forms two oppositely charged jets of material upon distortion.

7. The apparatus as described in claim 1, wherein the droplet is charged and forms a single jet of material upon distortion.

8. The apparatus as described in claim 1, wherein the target material is in one of an aqueous, gaseous, or solid phase.

9. The apparatus as described in claim 1, wherein the apparatus further comprises a droplet aligner including:

an adjustable stage for orienting the droplet positioner in at least two-dimensions, and an alignment imager for imaging the orientation of the jets of material in relation to the mass detector.

10. The apparatus as described in claim 9, wherein the alignment imager is a CCD camera.

11. The apparatus as described in claim 1, wherein the apparatus further comprises at least one supplemental analyzer for analyzing a physical aspect of the droplet in a field free environment in at least one of before or after the distortion of the droplet.

12. The apparatus as described in claim 1, further comprising a supplemental dynamics imager comprising:

a switched electrical field, and a time-resolved droplet imager in line of sight with said droplet, wherein the droplet imager is synchronized with the switching of the electrical field such that the dynamics of the distortion of a sample droplet can be monitored.

13. The apparatus as described in claim 12, wherein the time-resolved droplet imager is a pulsed flashlamp having a collimated beam focused at a CCD camera.

14. The apparatus as described in claim 1, wherein the droplet source produces a steady stream of probe liquid such that droplets are continually forming and growing, and wherein the electrical field generator is always activated such that when a droplet reaches a critical size it undergoes a distortion based on the function:

$$E_c^0 = \frac{1.625}{(8\pi)^{1/2}}\left(\frac{2\sigma}{\varepsilon_0 r}\right)^{1/2}$$

where r is the radius of the droplet, $E_c^0$ is the strength of the electrical field, and σ is the surface tension of the droplet material.

15. The apparatus as described in claim 14, wherein the droplet source is the outlet of a gas chromatograph.

16. A method of probing a chemical process comprising:

producing a droplet of probe liquid;

exposing the droplet of probe liquid to a target sample;

isolating and holding the exposed droplet of probe liquid within an electrical field generator;

generating an electrical field having a field strength sufficient to create a distortion within the probe liquid droplet, the distortion forming at least one jet of material that separates from the probe liquid droplet; and analyzing the at least one jet of material with a mass detector.

17. The method of claim 16, wherein the step of producing includes forming a droplet at the end of a capillary and hanging the droplet from the capillary outlet during the analysis.

18. The method of claim 16, wherein the step of isolating and holding includes suspending the droplet within an electrodynamic trap.

19. The method of claim 16, wherein the step of generating an electrical field includes generating an electrical field selected from the group consisting of static, pulsed, and oscillating.

20. The method of claim 16, wherein the droplet is neutral and forms two oppositely charged jets of material upon distortion.

21. The method of claim 16, wherein the droplet is charged and forms a single jet of material upon distortion.

22. The method of claim 16, wherein the target material is in one of an aqueous, gaseous, or solid phase.

23. The method of claim 16, wherein the step of exposing the droplet includes running an atmosphere of a gaseous target sample over the droplet.

24. The method of claim 16, wherein the step of exposing the droplet includes contacting the droplet with a solution of the target sample.

25. The method of claim 16, further comprising the step of aligning the orientation of the jets of material with the entrance to the mass detector.

26. The method of claim 16, further comprising the step of analyzing a physical aspect of the droplet in a field free environment with a supplemental analyzer in at least one of before or after the distortion of the droplet.

27. The method of claim 16, further comprising the step of determining the strength of the electrical field and the timing of the electrical field discharge needed in the step of generating an electrical field through a dynamics measurement itself comprising:

switching the electrical field; and taking a plurality of time-resolved images of the droplet in synchronization with the switching of the electrical field.

28. The method of claim 16, wherein the step of producing a droplet includes introducing a steady stream of probe liquid such that droplets are continually forming and growing; and wherein the electrical field is constantly generated such that when a droplet reaches a critical size it undergoes a distortion based on the function:

$$E_c^0 = \frac{1.625}{(8\pi)^{1/2}}\left(\frac{2\sigma}{\varepsilon_0 r}\right)^{1/2}$$

where r is the radius of the droplet, $E_c^0$ is the strength of the electrical field, and σ is the surface tension of the droplet material.

29. The method of claim 16, wherein the source of the probe liquid is the outlet of a gas chromatograph.

* * * * *